US011745972B2

(12) United States Patent
Tanaka

(10) Patent No.: US 11,745,972 B2
(45) Date of Patent: Sep. 5, 2023

(54) PRINTING APPARATUS AND CONTROL METHOD AND CONTROL PROGRAM FOR PRINTING APPARATUS

(71) Applicant: KONICA MINOLTA, INC., Tokyo (JP)

(72) Inventor: Kazuto Tanaka, Ichikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 224 days.

(21) Appl. No.: 17/225,301

(22) Filed: Apr. 8, 2021

(65) Prior Publication Data

US 2021/0347596 A1 Nov. 11, 2021

(30) Foreign Application Priority Data

May 8, 2020 (JP) ..... 2020-082552

(51) Int. Cl.
*B65H 35/00* (2006.01)

(52) U.S. Cl.
CPC ..... *B65H 35/008* (2013.01); *B65H 2511/216* (2013.01); *B65H 2511/52* (2013.01)

(58) Field of Classification Search
CPC ..... B65H 35/008; B65H 2511/216; B65H 2511/52; G03G 15/5029; G03G 15/6582
See application file for complete search history.

(56) References Cited

U.S. PATENT DOCUMENTS

| | | | | |
|---|---|---|---|---|
| 9,019,554 | B2 * | 4/2015 | Iseki | G06F 3/1285 358/1.15 |
| 9,906,683 | B2 * | 2/2018 | Miyagi | H04N 1/2369 |
| 9,973,651 | B2 * | 5/2018 | Mita | G06K 15/1874 |
| 10,474,399 | B2 * | 11/2019 | Yoshino | H04N 1/3877 |
| 2021/0014380 | A1 * | 1/2021 | Imanishi | G06F 3/1296 |
| 2021/0289094 | A1 * | 9/2021 | Sawai | H04N 1/00702 |

FOREIGN PATENT DOCUMENTS

| | | | |
|---|---|---|---|
| JP | 2006137070 | A | 6/2006 |
| JP | 2014157385 | A | 8/2014 |
| JP | 2019217676 | A * | 12/2019 |

* cited by examiner

*Primary Examiner* — Patrick H Mackey
(74) *Attorney, Agent, or Firm* — Holtz, Holtz & Volek PC

(57) ABSTRACT

A printing apparatus includes: an image former that forms an image on a pre-cutting sheet; a cutter that cuts the pre-cutting sheet on which the image is formed; and a hardware processor that controls the image former, wherein the hardware processor acquires image deviation information related to a deviation of an image with respect to a post-cutting sheet, and corrects at least one of a position, a tilt, or a shape of an image formed on the pre-cutting sheet so as to eliminate the deviation of the image based on the image deviation information.

16 Claims, 19 Drawing Sheets

PRINTING APPARATUS AND CONTROL METHOD AND CONTROL PROGRAM FOR PRINTING APPARATUS

The entire disclosure of Japanese patent Application No. 2020-082552, filed on May 8, 2020, is incorporated herein by reference in its entirety.

BACKGROUND

Technological Field

The present disclosure relates to a printing apparatus and a control method and a control program for the printing apparatus.

Description of the Related Art

As one of post-processing devices provided after an image forming apparatus, a cutting device (also referred to as a trimmer unit (TU)) for cutting a recording medium such as paper is known.

Regarding the cutting device, Japanese Patent Application Laid-Open No. 2014-157385 discloses a display device that "controls to cut out and display an image area after the cutting process by the post-processing device 6 from an image area of the image as the image formation target, and not to display an image area that is cut off in the cutting process" (see paragraph [0032]).

Further, Japanese Patent Application Laid-Open No. 2006-137070 discloses an image recording device that "includes a detection means for detecting a position of a moving carriage 1 that moves with a recording head 1*a* being mounted, a cutting means 120 for cutting a recording medium 101, and a moving means for moving the cutting means along the recording medium, in which when the cutting means being moved by the moving means is stopped, the moving means is controlled by detecting that the cutting means has moved to a stop position by the position of the carriage" (see [Summary]).

Position accuracy of an image formed on the paper by the image forming apparatus can be maintained correctly by using a conventional technique such as an image calibration control unit (ICCU). On the other hand, when the sheet on which an image is formed is cut by a cutting device, the image on the post-cutting sheet may be deviated in position or tilted with respect to the post-cutting sheet. As a cause of this, when the cutting device is attached to the image forming apparatus, the cutting device may not be attached parallel to the sheet conveying direction, or a blade of the cutting device may be attached in a bent state.

Accordingly, the user needs to adjust the cutting device when the image is not correctly arranged on the post-cutting sheet, and this adjustment work requires time and effort. Therefore, there is a need for a technique for cutting at a correct position with respect to an image formed on a sheet by a simple method when the attachment position of the cutting device is faulty.

SUMMARY

The present disclosure has been made to solve the above-described problems. In a certain aspect, a technique for cutting at a correct position with respect to an image formed on a sheet by a simple method when the attachment position of the cutting device is faulty is disclosed.

To achieve the abovementioned object, according to an aspect of the present invention, a printing apparatus reflecting one aspect of the present invention comprises: an image former that forms an image on a pre-cutting sheet; a cutter that cuts the pre-cutting sheet on which the image is formed; and a hardware processor that controls the image former, wherein the hardware processor acquires image deviation information related to a deviation of an image with respect to a post-cutting sheet, and corrects at least one of a position, a tilt, or a shape of an image formed on the pre-cutting sheet so as to eliminate the deviation of the image based on the image deviation information.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
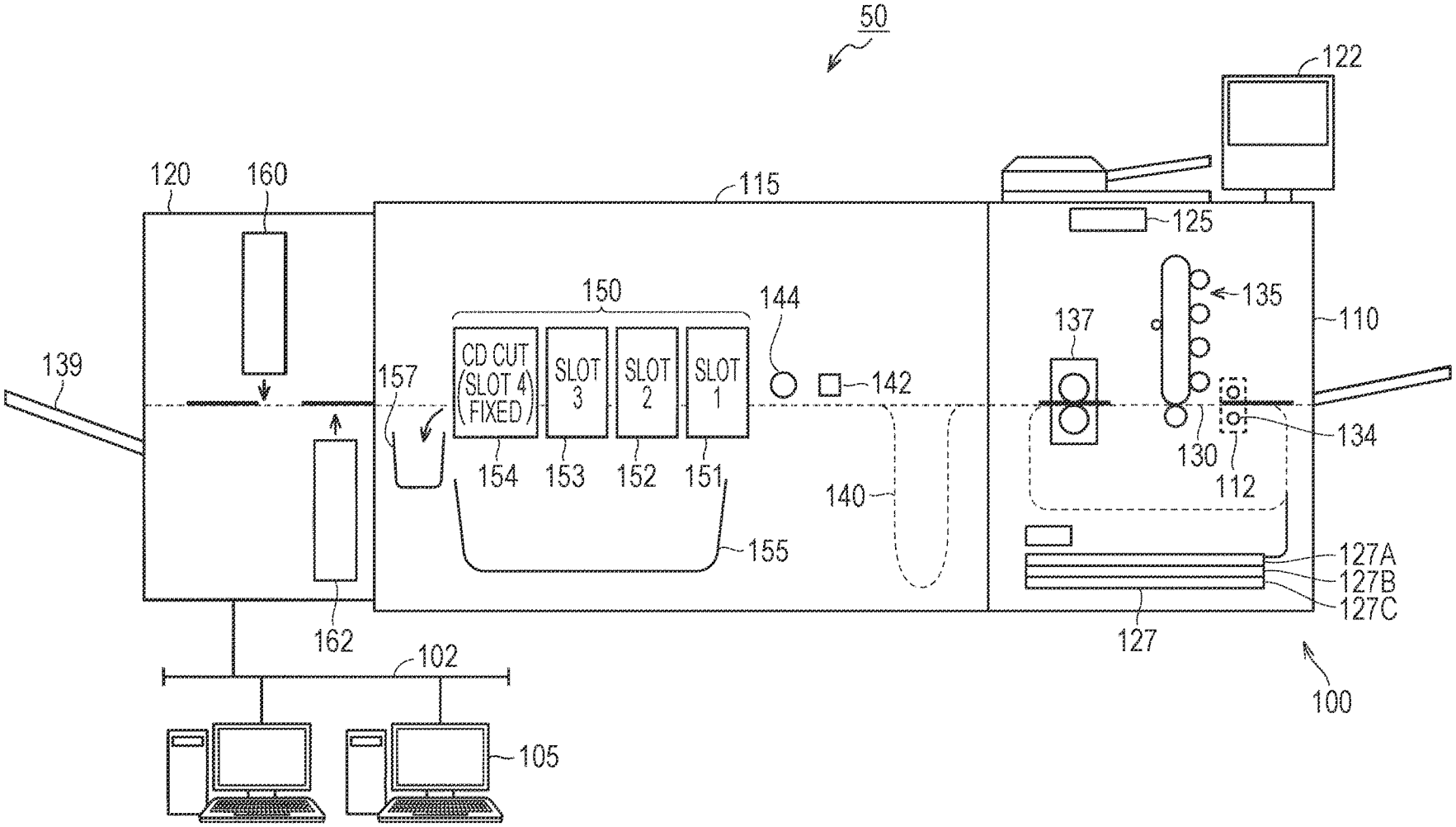
FIG. 1 is a diagram illustrating an example of a configuration of a printing system.

Hereinafter, a printing apparatus according to one or more embodiments of the present invention will be described in detail with reference to the drawings. However, the scope of the invention is not limited to the disclosed embodiments. When the number or quantity or the like is referred to in the embodiments described below, the scope of the present disclosure is not necessarily limited to the number or quantity and the like unless otherwise specified.

The drawings are not illustrated according to an actual dimensional ratio, and the ratio may be changed to facilitate understanding of a structure or to clarify the structure. The same or corresponding parts are designated by the same reference numerals, and their descriptions are not repeated. Further, when referring to a plurality of identical configurations, they are described by adding A, B, . . . at the end of a reference sign 123 like configuration 123A, 123B, and when they are collectively referred to, they are referred to as a configuration 123. Note that each embodiment described below may be selectively combined as appropriate.

Hereinafter, a "sheet" is a recording medium on which an image is formed, and includes, for example, a sheet-like recording medium formed by paper or a material other than paper.

The "pre-cutting sheet" represents one pre-cutting sheet cut by a cutter, and a "post-cutting sheet" represents a sheet after four ends of one sheet have been cut off and removed.

First Embodiment

[Overview of Hardware Configuration of Printing System and Operation Thereof]

A configuration of a printing system 50 and operation thereof in a first embodiment will be described with reference to FIGS. 1 and 2. FIG. 1 is a diagram illustrating an example of the configuration of the printing system 50.

As illustrated in FIG. 1, the printing system 50 includes a printing apparatus 100 and at least one client terminal 105.

The printing apparatus 100 is connected to a client terminal 105 by a communication line 102. The communication line 102 may be wired or wireless.

The client terminal 105 transmits a print job executed by the printing apparatus 100 to the printing apparatus 100 via the communication line 102. In a certain aspect, the user can input or change setting information in the print job by operating the client terminal 105. As an example, the setting information in the print job includes various settings such as a file name of image data to be printed, the number of copies, aggregate printing, single-sided/double-sided printing, color/monochrome printing, and a cutting position on a pre-cutting sheet. In a certain aspect, the client terminal 105 can be achieved by an information processing device such as a personal computer (PC), a smartphone, or a tablet terminal.

The printing apparatus 100 includes an image former 110, a conveying unit 112, a cutter 115, an image reader 120, an operation panel 122, and a controller 125. Detailed configurations of the operation panel 122 and the controller 125 will be described later with reference to FIG. 2.

The image former 110, the cutter 115, and the image reader 120 are connected in series in this order. In another aspect, a post-processing device that further performs post-processing such as stapling, punching, and folding on the sheet may be connected to the subsequent stage of the image reader 120.

The image former 110 includes a paper feed tray 127, a toner image forming unit 135, and a fixing unit 137.

The paper feed tray 127 accommodates sheets. In the example of FIG. 1, the paper feed tray 127 includes a plurality of paper feed trays 127A, 127B, and 127C, and each paper feed tray 127 accommodates multiple types of sheets, which differ in size, paper quality, basis weight ($g/m^2$), or the like.

The conveying unit 112 conveys the sheet. The conveying unit 112 includes a roller pair 134 that is installed so as to face each other across a conveying path 130. The conveying unit 112 conveys the sheet along the conveying path 130 by rotating in a predetermined direction while holding the sheet by the roller pair 134. Note that in FIG. 1, one roller pair 134 is illustrated for simplification of description, but in practice, a plurality of roller pairs is arranged along the conveying path 130.

The conveying unit 112 takes out sheets of the type specified by a print job one by one from the paper feed tray 127. The conveying unit 112 conveys the sheets in the order of the toner image forming unit 135, the fixing unit 137, the cutter 115, and the image reader 120, and finally discharges the sheets to the discharge tray 139.

The toner image forming unit 135 forms a toner image of characters, an image, or the like on a sheet to be fed by an electrophotographic method based on image data (hereinafter, may be referred to as "original data") in the print job specified by the user. The toner image forming unit 135 forms a toner image constituted of toners of four colors of yellow (Y), magenta (M), cyan (C), and key plate (K) on a sheet based on a command from the controller 125.

More specifically, in a case of secondary transfer method, for example, the toner image forming unit 135 uniformly charges a photoconductor surface (charging step), exposes the charged photoconductor surface to provide an electrostatic latent image (exposure step), causes toner particles to adhere to the latent image (development step), transfers the developed toner image to an intermediate transfer body (primary transfer step), and thereafter transfers the toner image onto a sheet (secondary transfer process).

The fixing unit 137 heats and pressurizes the sheet on which the toner image is formed by the toner image forming unit 135.

In another aspect, the image former 110 may form a monochrome image instead of a color image. In still another aspect, the image former 110 may form an image on a sheet by, for example, an inkjet method, and the method of forming an image on the sheet is not particularly limited.

The cutter 115 includes a long conveying path 140, a sensor 142, a roller pair 144, a functional unit 150, a waste box 155, and a card tray 157.

The long conveying path 140 is a conveying path for long sheets for cases where the sheet on which the image is formed by the image former 110 is a long sheet. The conveying unit 112 conveys the long sheet while aligning it on the long conveying path 140. More specifically, the conveying unit 112 temporarily holds the long sheet in the long conveying path 140 and adjusts the orientation of the long sheet with respect to the conveying direction.

The sensor 142 optically detects end faces of the conveyed sheet, that is, a front end and a rear end. The controller 125 controls the timing of sheet transfer based on a detection result of the sensor 142.

The roller pair 144 is constituted of two steering rollers used to tilt the direction of a sheet edge of the pre-cutting sheet diagonally with respect to the conveying direction at the cutter 115. One roller of the roller pair is provided at a predetermined interval with respect to the other roller in a direction perpendicular to the conveying direction of the pre-cutting sheet. The conveying unit 112 can rotate each of the rollers constituting the roller pair 144 at a different speed according to a control command from the controller 125. An angle between the conveying direction of the cutter 115 and the direction of the sheet edge of the pre-cutting sheet can be adjusted according to a rotation speed difference of the rollers.

The functional unit 150 is achieved by one or more functional modules. More specifically, the functional unit 150 is achieved by loading one or more functional modules into a plurality of slots 151, 152, 153, and 154 arranged along the conveying path 130.

The functional module may be, for example, one of a cross direction (CD) cutting module, a feed direction (FD) cutting (top and bottom slit) module, a bleed slit module, a crease module, a business card slit module, a CD perforation module, an FD perforation module, and the like. Here, the "FD direction" represents the sheet conveying direction. On the other hand, the "CD direction" represents a direction perpendicular to the sheet conveying direction. Note that in the functional unit 150, functional modules other than these may be loaded. Specifically, the FD cutting module cuts the sheet in the sheet conveying direction. The CD cutting module cuts the sheet in the CD direction.

The bleed slit module forms a slit in the FD direction. Specifically, the bleed slit module cuts the sheet at two parallel cutting positions in, for example, bleed slit processing. Thus, a slit (groove) is formed between the two cutting positions. The crease module forms streaks in a predetermined direction, for example, in the CD direction.

The business card slit module cuts paper to the size of a business card, so that a plurality of slits is formed in the FD direction. The CD perforation module forms perforations in the CD direction on the sheet. The FD perforation module forms perforations in the FD direction on the sheet.

In the example of FIG. 1, the FD cutting module is loaded in the slot 151. Non-functional dummy modules are loaded in the slots 152 and 153. In the slot 154, a CD cutting module is loaded. By combining these modules, the functional unit 150 cuts the pre-cutting sheet in four ways. Note that the four-way cutting is a process of cutting the top, bottom, left, and right edges of the sheet.

The waste box 155 accumulates waste that has been cut by the functional unit 150 and has fallen due to its own weight. The user regularly disposes of the waste in the waste box 155.

The card tray 157 accommodates each post-cutting sheet that has fallen due to its own weight when the pre-cutting sheet is cut into cards or a plurality of business card-sized sheets by the business card slit module and the CD cutting module.

The image reader 120 generates read image data by optically reading the shape of the post-cutting sheet and an image formed on the post-cutting sheet. The image reader 120 includes scanners 160 and 162 for reading an upper surface and a lower surface of the post-cutting sheet, respectively.

The scanners 160 and 162 are arranged downstream of the cutter 115 in the sheet conveying path 130, optically read an image formed on the sheet, and generate read image data corresponding to a scanned surface.

In the case of FIG. 1, the scanner 160 generates read image data corresponding to an upper surface of the sheet, and the scanner 162 generates read image data corresponding to a lower surface of the sheet. The scanners 160 and 162 include a sensor that receives a light emitted from a light source and reflected on a surface of a sheet by a light receiving element and outputs a signal according to intensity of the light. The scanners 160 and 162 may include line sensors in which a plurality of light receiving elements is arranged at predetermined intervals in a direction orthogonal to the sheet conveying direction, or may be ones that read only a predetermined area in the direction orthogonal to the sheet conveying direction.

The operation panel 122 receives an operation input to the printing apparatus 100 from the user. Moreover, the operation panel 122 displays a screen such as a setting screen based on a command from the controller 125.

The controller 125 controls operation of the printing apparatus 100. A more detailed hardware configuration of the operation panel 122 and the controller 125 will be described below.

Figure 2:
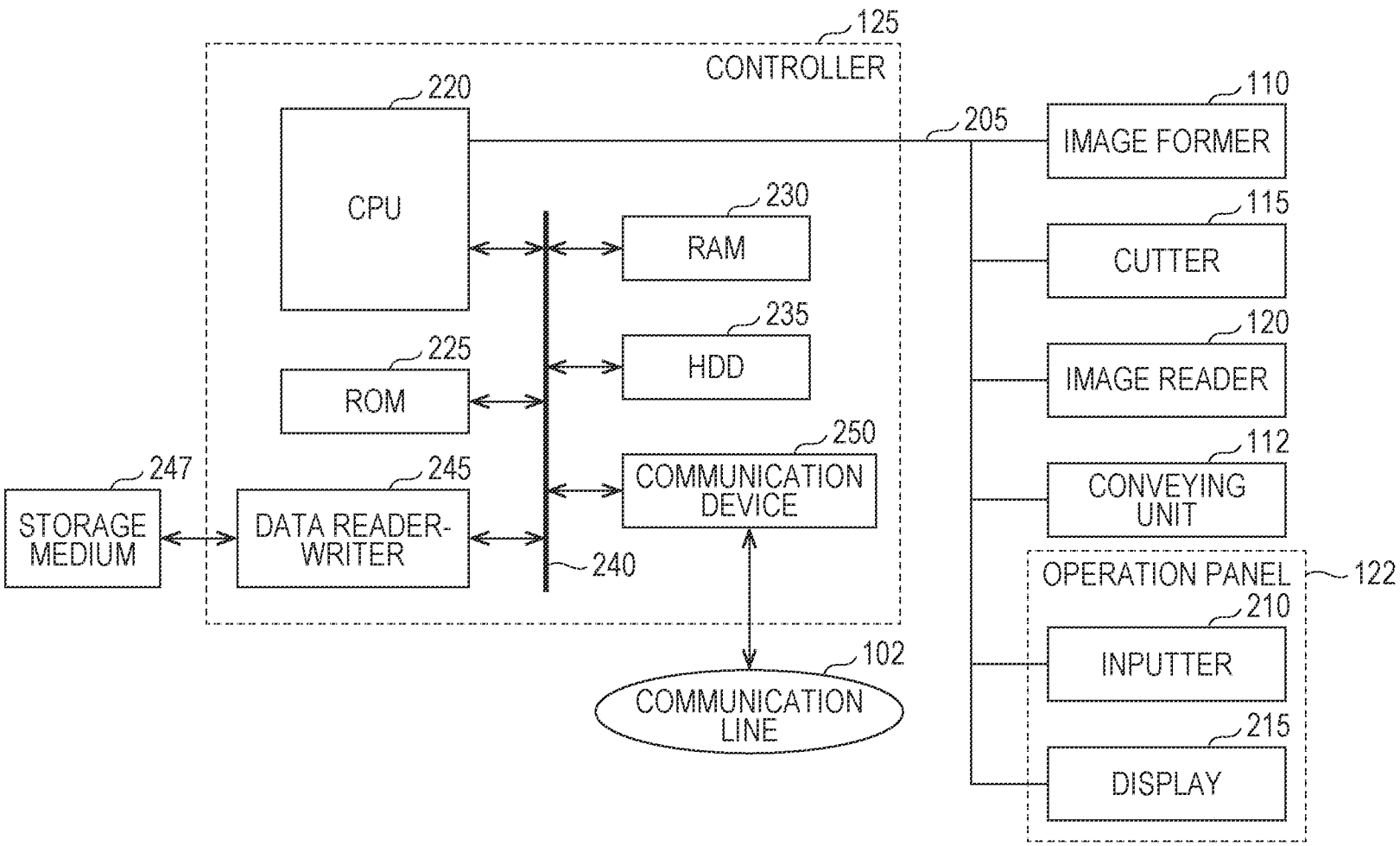
FIG. 2 is a diagram illustrating an example of a more detailed hardware configuration of an operation panel and a controller in association with other devices.

FIG. 2 is a diagram illustrating an example of a more detailed hardware configuration of the operation panel 122 and the controller 125 in association with other devices.

In FIG. 2, a cutter 115, an image reader 120, a conveying unit 112, and an image former 110 are also illustrated. Since their operations have been described with reference to FIG. 1, the description will not be repeated.

The operation panel 122 includes an inputter 210 that receives an input from the user and a display 215 that displays character information, image information, and the like to the user. The operation panel 122 may be constituted of a touch screen in which an inputter 210 such as a plurality of touch sensors and a display 215 such as a liquid crystal monitor are combined. The operation panel 122 may further include a plurality of physical keys as the inputter 210.

The controller 125 mutually communicates with the image former 110, the cutter 115, the image reader 120, the conveying unit 112, and the operation panel 122 via the bus 205.

The controller 125 includes a central processing unit (CPU) 220, a read only memory (ROM) 225, a random access memory (RAM) 230, a hard disk drive (HDD) 235, a data reader-writer 245, a communication device 250, and a bus 240 connecting these components. The CPU 220 executes a control program for controlling the printing apparatus 100.

The ROM 225 stores programs such as an operating system (OS) executed by the CPU 220. In some aspects, the ROM 225 can be achieved by an erasable programmable ROM (EPROM), an electrically erasable programmable ROM (EEPROM), or a flash memory.

The application program executed by the CPU 220 and data are loaded into the RAM 230 from the HDD 235. In a certain aspect, the RAM 230 can be achieved by a static random access memory (SRAM) or a dynamic random access memory (DRAM).

The HDD 235 is an example of an auxiliary storage device, and stores various programs and data used in the printing apparatus 100. In other aspects, a solid state drive (SSD) or the like may be used instead of the HDD 235.

An external storage medium 247 such as an HDD is detachably attached to the data reader-writer 245. The data reader-writer 245 writes data or a program containing an image to the mounted storage medium 247 or reads data or a program from the storage medium 247 according to an instruction from the CPU 220. The storage medium 247 is not limited to the HDD, and includes a medium that stores information such as a recorded program electrically, magnetically, optically, mechanically, or by chemical action so that a computer or other device can read the information such as the program.

The communication device 250 communicates with an external device such as the client terminal 105 via the communication line 102. In a certain aspect, the communication device 250 is implemented by a wired local area network (LAN) port, a Wireless Fidelity (Wi-Fi) (registered trademark) module, or the like. The printing apparatus 100 receives a job from an external device such as the client terminal 105 via the communication device 250. The printing apparatus 100 may include a plurality of communication devices 250.

[Deviation of Image on Post-Cutting Sheet Due to Faulty Attachment of Cutter]

Figure 3:
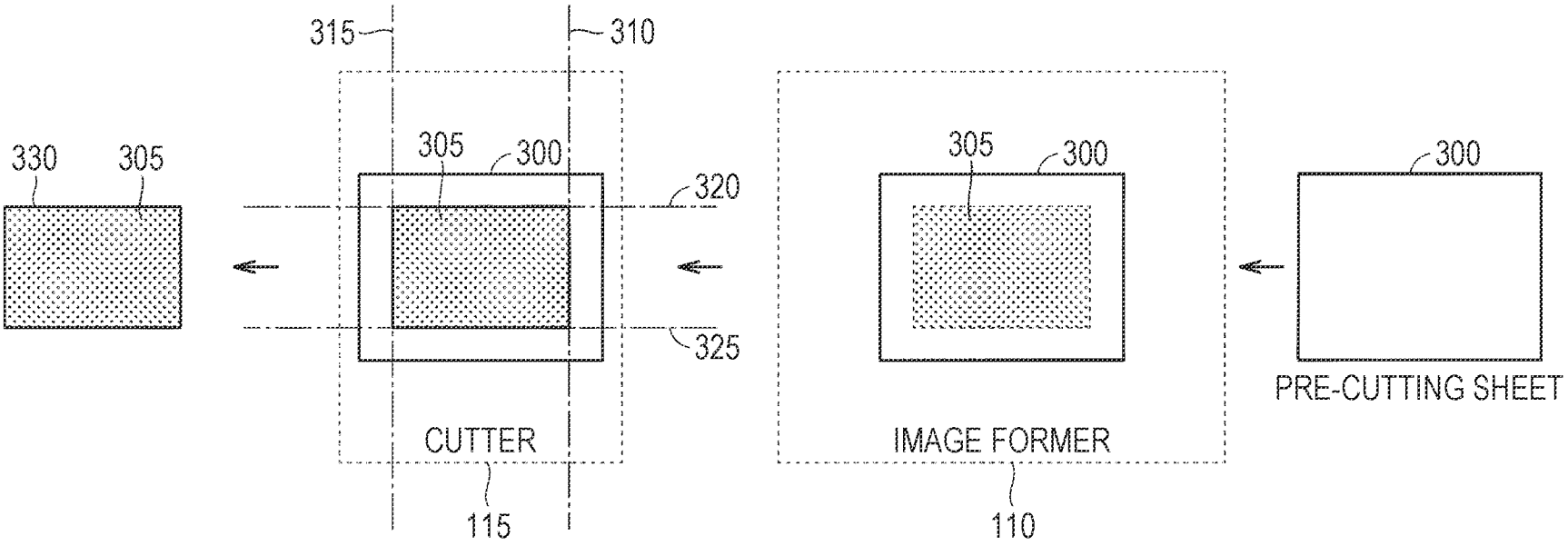
FIG. 3 is a diagram schematically illustrating a state in which a pre-cutting sheet is sequentially processed by an image former and a cutter when an FD direction of the cutter is parallel to an FD direction of the image former.
Figure 4:
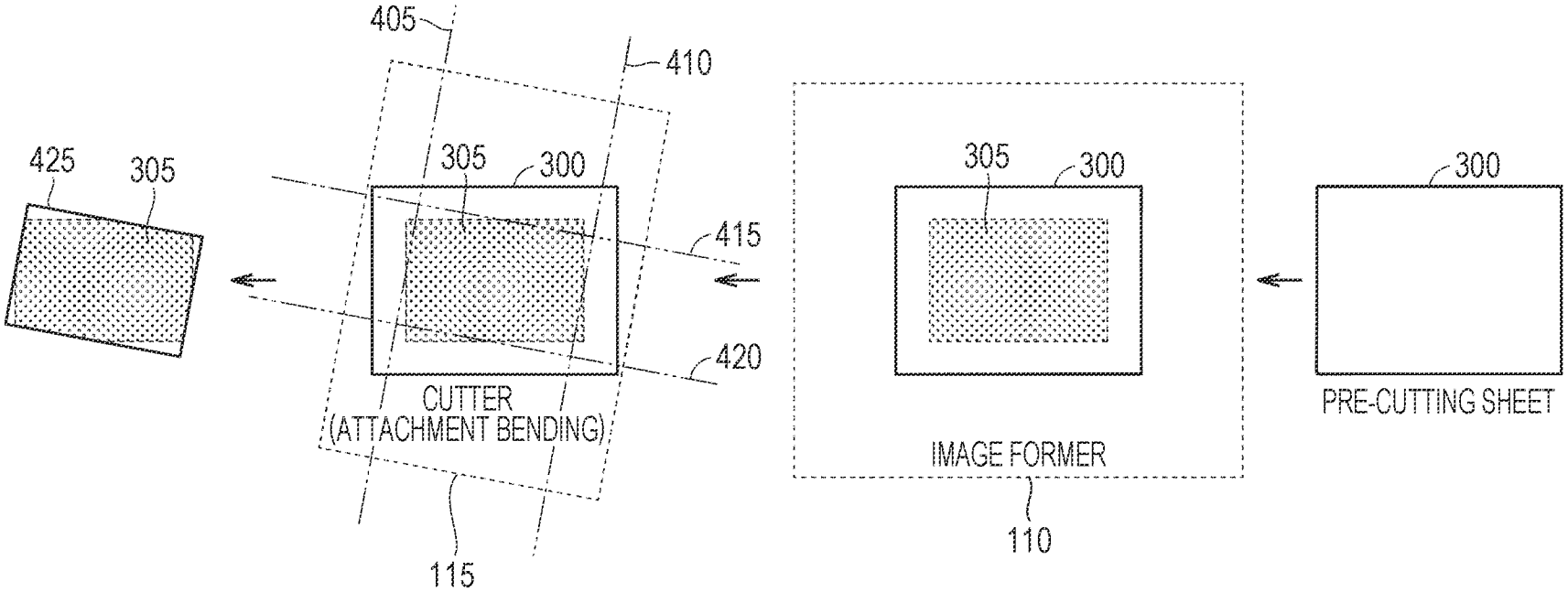
FIG. 4 is a diagram schematically illustrating a state in which a pre-cutting sheet is processed in the order of the image former and the cutter when the FD direction of the cutter is not parallel to the FD direction of the image former.
Figure 5:
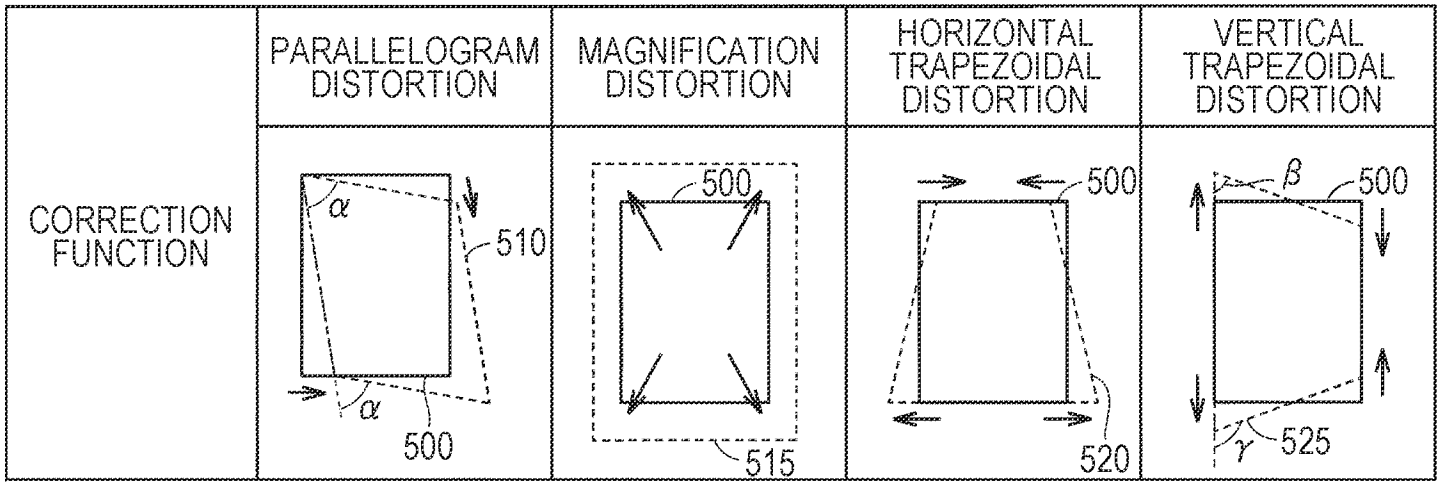
FIG. 5 is a diagram illustrating an example of a shape distortion of an image.

With reference to FIGS. 3 to 5, a deviation of an image on a post-cutting sheet, which is one of the problems of the present disclosure, will be described. When the attachment position of the cutter 115 is faulty, the position of an image on the post-cutting sheet may be off the center of the post-cutting sheet, the image may be tilted with respect to the post-cutting sheet, or the shape of the image may be deformed.

First, a case where the attachment position of the cutter 115 with respect to the image former 110 is normal will be described with reference to FIG. 3.

FIG. 3 is a diagram schematically illustrating a state in which a pre-cutting sheet 300 is sequentially processed by the image former 110 and the cutter 115 when the FD direction of the cutter 115 is parallel to the FD direction of the image former 110.

The image former 110 forms an image on the pre-cutting sheet 300 based on a print job. Hereinafter, a range in which an image based on the print job is formed is referred to as an image forming area 305. In the example of FIG. 3, the image forming area 305 is illustrated by hatching and has a rectangular shape. By using a conventional technique such as ICCU, the image forming area 305 can be properly arranged so as to be located at the center of the pre-cutting sheet 300.

The cutter 115 performs a four-way cutting process on the pre-cutting sheet 300 in which an image is formed in the image forming area 305 along cutting lines 310, 315, 320, and 325. Thus, all sides of the pre-cutting sheet 300 are cut off, and as a result, a post-cutting sheet 330 is obtained. Here, the "cutting line" means a line representing a cutting position on the pre-cutting sheet 300. The cutting position can be set based on setting information in the print job. In the case of FIG. 3, cutting lines 310, 315, 320, and 325 are arranged along outer edges of the rectangular image forming area 305.

Moreover, in the case of FIG. 3, the cutter 115 is attached in parallel to the image former 110. In this case, if the cutter 115 cuts the pre-cutting sheet 300 at the cutting position set based on the print job, the actual cutting position represented by the cutting lines 310, 315, 320, and 325 matches a target cutting position based on the print job.

The cutting lines 310 and 315 are parallel to the CD direction in the image former 110. The target cutting lines 320 and 325 are parallel to the FD direction in the image former 110. In the case of the post-cutting sheet 330 illustrated in FIG. 3, each side of the rectangular image forming area 305 coincides with each sheet edge of the post-cutting sheet 330. Moreover, the center of the image forming area coincides with the center of the pre-cutting sheet 300, and the image on a post-cutting sheet 425 does not deviate.

Note that in another aspect, the cutting lines may be arranged so as to be parallel to corresponding sides of the rectangular image forming area 305 but not to coincide with each other. For example, in consideration of a case where the cutting position is deviated, a position slightly inside outer edges of the image forming area may be set as the position of the cutting line.

Next, a case where an attachment position of the cutter 115 with respect to the image former 110 is faulty will be described with reference to FIG. 4.

FIG. 4 is a diagram schematically illustrating a state in which the pre-cutting sheet 300 is processed in the order of the image former 110 and the cutter 115 when the FD direction of the cutter 115 is not parallel to the FD direction of the image former 110.

With reference to FIG. 4, the image former 110 forms an image in the image forming area 305 on the pre-cutting sheet 300. The cutter 115 performs a four-way cutting process on the pre-cutting sheet 300 along cutting lines 405, 410, 415, and 420. Thus, all sides of the pre-cutting sheet 300 are cut off, and as a result, the post-cutting sheet 425 is obtained.

Here, unlike the example of FIG. 3, in the example of FIG. 4, since the cutter 115 is attached in a bent state on the image former 110, the FD direction of the cutter 115 is not parallel to the FD direction of the image former 110. Therefore, the actual cutting position represented by the cutting lines the 405, 410, 415, and 420 is different from the target cutting position represented by the cutting lines 310, 315, 320, and 325 in FIG. 3.

Consequently, as illustrated in FIG. 4, the cutting lines 405 and 410 are not parallel to the CD direction in the image former 110. The cutting lines 415 and 420 are not parallel to the FD direction in the image former 110. Further, unlike the case of FIG. 3, each side of the rectangular image forming area 305 does not coincide with each side of the post-cutting sheet 330, and is not parallel to each side of the post-cutting sheet 330. The center of the image forming area 305 does not coincide with the center of the pre-cutting sheet 300. In the example of FIG. 4, the image forming area 305 is tilted with respect to the post-cutting sheet 425.

In another aspect, even when the CD cutting module and the FD cutting module attached respectively to the slots 151 and 154 of the cutter 115 are attached in a bent state with respect to the sheet conveying direction, the image forming area 305 can be similarly tilted with respect to the post-cutting sheet 425.

[Shape Distortion of Image]

With reference to FIG. 5, a distortion in shape of an image (hereinafter, referred to as a "shape distortion") will be described. FIG. 5 is a diagram illustrating an example of a shape distortion of an image.

In FIG. 5, an original image 500 and images 510, 515, 520, and 525 with shape distortions are illustrated.

The image 500 is a rectangular image. On the other hand, each of the images 510, 515, 520, and 525 is an image in which a shape distortion such as a parallelogram distortion, a magnification distortion, a horizontal trapezoidal distortion, or a vertical trapezoidal distortion occurs from the image 500, respectively. Note that arrows in FIG. 5 represent directions in which shapes of the images 510, 515, 520, and 525 are deformed on the basis of the rectangular image 500.

The magnification distortion is a phenomenon in which the image 515 is magnified and deformed in at least one direction in a vertical or horizontal direction. In the present disclosure, the magnification distortion includes not only cases where magnification in the vertical direction and magnification in the horizontal direction are different, but also cases where they are the same.

The parallelogram distortion refers to an image distortion in which a rectangular image is deformed into a parallelogram. When the parallelogram distortion has occurred in the image 510 of a quadrangle, the angle $\alpha$ of any internal angle of the quadrangle is equal to the angle of an external angle that is the corresponding angle of the internal angle, and the angle $\alpha$ is different from 90°.

The trapezoidal distortion refers to an image distortion in which a rectangular image is deformed into a trapezoidal image. The case of the image 525 in which the trapezoidal distortion has occurred, unlike the case of the parallelogram distortion, includes cases where an angle $\beta$ of an internal angle of a vertex of a quadrangle and an angle $\gamma$ of an external angle that is the corresponding angle of the internal angle, are not equal.

Whether or not the shape distortion as described above has occurred can be determined by comparing original data for the image with read image data.

Generally, in an image formed on a sheet, such shape distortion occurs due to a timing at which the toner image forming unit 135 transfers a toner image to a sheet, a tilt of the sheet with respect to the conveying direction during transfer, and the like.

[Image Correction Based on Image Deviation Information]

Figure 6:
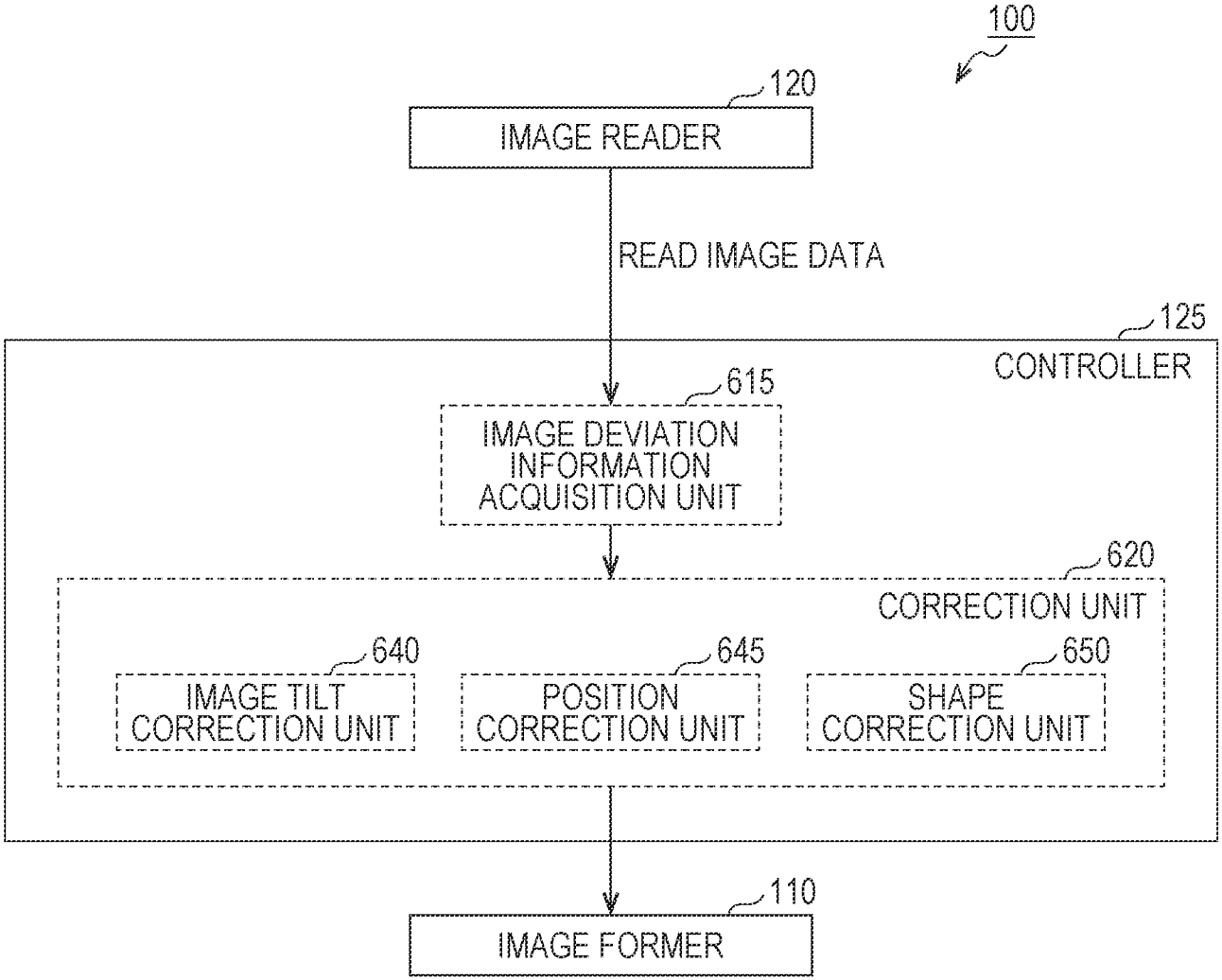
FIG. 6 is a functional block diagram describing an example of a configuration of the controller for correcting a deviation of an image on a post-cutting sheet.

FIG. 6 is a functional block diagram describing an example of a configuration of the controller 125 for correcting a deviation of an image on a post-cutting sheet. With reference to FIG. 6, the controller 125 includes an image deviation information acquisition unit 615 and a correction unit 620. First, the image deviation information acquisition unit 615 will be described.

The image deviation information acquisition unit 615 acquires image deviation information related to a deviation of an image with respect to a post-cutting sheet, based on read image data generated by the image reader 120. For example, the image deviation information acquisition unit 615 acquires a tilt of an image, a position of an image, a shape of an image, and the like as the image deviation information.

Specifically, the image deviation information acquisition unit 615 acquires the tilt of an image with respect to a sheet edge of the post-cutting sheet as the image deviation information. For example, when the image former 110 forms a rectangular image on the pre-cutting sheet, the image deviation information acquisition unit 615 applies an edge detection technique to the read image data, to thereby calculate a tilt of any side of the rectangular image with respect to a lower edge of the post-cutting sheet. Thus, the tilt of the image with respect to the lower edge of the post-cutting sheet can be acquired. In another aspect, the image deviation information acquisition unit 615 may acquire a tilt of the image with respect to an upper edge, a right edge, or a left edge of the post-cutting sheet as the image deviation information.

Moreover, the image deviation information acquisition unit 615 acquires the position of the image on the basis of the post-cutting sheet as the image deviation information. For example, when the image former 110 forms a rectangular image on the pre-cutting sheet, the image deviation information acquisition unit 615 applies a publicly known image processing technique to the read image data, to thereby calculate coordinates of four vertices of the formed rectangular image. The image deviation information acquisition unit 615 calculates center coordinates of the rectangular image as first center coordinates by calculating an average of the coordinate values of the four vertices. At this time, the method of determining the coordinate system is not particularly limited. Moreover, the image deviation information acquisition unit 615 calculates center coordinates of the post-cutting sheet as second center coordinates by calculating the average of the coordinate values of the four vertices of the post-cutting sheet. Based on the first center coordinates and the second center coordinates, a shift amount of an image in an in-plane direction on the post-cutting sheet (hereinafter referred to as "positional deviation amount") can be calculated.

Further, the image deviation information acquisition unit 615 acquires a shape of an image on the post-cutting sheet as the image deviation information. For example, when the image former 110 forms a rectangular image on the pre-cutting sheet, the image deviation information acquisition unit 615 acquires lengths of four sides, an internal angle or an external angle of each vertex, and the like as the image deviation information. As described with reference to FIG. 5, the image deviation information acquisition unit 615 determines whether or not a magnification distortion, a parallelogram distortion, a trapezoidal distortion, or the like has occurred based on this information.

Next, the correction unit 620 will be described. The correction unit 620 corrects at least one of a position, a tilt, or a shape of the image formed on the pre-cutting sheet so that a deviation of an image with respect to the post-cutting sheet is eliminated based on the image deviation information acquired by the image deviation information acquisition unit 615.

More specifically, the correction unit 620 includes an image tilt correction unit 640, a position correction unit 645, and a shape distortion correction unit 650.

The image tilt correction unit 640 calculates a correction amount of a tilt of an image formed on the pre-cutting sheet based on a tilt of an image acquired by the image deviation information acquisition unit 615. The image tilt correction unit 640 corrects the tilt of the image formed on the pre-cutting sheet based on the correction amount. Specifically, the image tilt correction unit 640 corrects a tilt of an image so that the image formed on the pre-cutting sheet does not tilt with respect to an actual cutting line (that is, a sheet edge of the post-cutting sheet).

The position correction unit 645 calculates a correction amount for correcting a position of an image formed on the pre-cutting sheet based on the center coordinates acquired by the image deviation information acquisition unit 615. More specifically, the position correction unit 645 calculates a correction amount for correcting a position of an image actually formed on the post-cutting sheet to a position where the image has to be originally formed on the post-cutting sheet by calculating differences between first center coordinates and second center coordinates (that is, the "position deviation amount"). The position correction unit 645 shifts the entire image formed on the pre-cutting sheet by the position deviation amount based on the calculated correction amount.

The shape distortion correction unit 650 calculates at least one or more correction amounts for correcting a shape distortion when the shape distortion has occurred. The shape distortion correction unit 650 corrects the image data based on the correction amount. Some examples will be described below.

For example, a case where an image formed on the pre-cutting sheet is corrected from an image distorted into a parallelogram like the image 510 in FIG. 5 to the rectangular image 500 will be described. In this case, the shape distortion correction unit 650 calculates a correction amount 90°-α° for the image so that the angle α of an internal angle of the formed image and the angle α of the corresponding angle to the internal angle become 90°. The shape distortion correction unit 650 expands the original data of the image formed on the pre-cutting sheet into the memory so that the data is tilted by 90°-α°.

Next, a case where the image formed on the pre-cutting sheet is corrected from an image in which a magnification distortion has occurred like the image 515 to the rectangular image 500 will be described. For example, it is assumed that an image formed on the post-cutting sheet is deformed in magnification by a times in a main scanning direction and b times in a sub scanning direction from the original image set in the print job. In this case, the shape distortion correction unit 650 calculates the correction amount as 1/a times for the main scanning direction and 1/b times for the sub scanning direction of the original data of the image. Based on the calculated correction amount, the shape distortion correction unit 650 expands the original data of the image into the memory so that the original data is enlarged or reduced in a certain direction.

In a certain aspect, the shape distortion correction unit 650 may correct the original data so that the image on the post-cutting sheet is deformed in magnification in a direction parallel or perpendicular to an edge of the post-cutting sheet according to the size of the post-cutting sheet acquired based on the read image data. Thus, it is possible to suppress a possibility that a margin that is not set in the print job is generated between the image and sheet edges.

Next, a case where the image formed on the pre-cutting sheet is corrected from an image in which a trapezoidal distortion has occurred like the images 520 and 525 to the rectangular image 500 will be described. In this case, based on a pixel value of every line in pixels of original data for the formed image and a pixel value of a portion corresponding to the one line in the read image data of the image, the shape distortion correction unit 650 calculates a tilt of the part with respect to the one line. The shape distortion correction unit 650 calculates a correction amount for the original data of the image based on the calculated tilt. The shape distortion correction unit 650 corrects the original data line by line so that the tilt becomes zero based on the correction amount.

In another aspect, the shape distortion correction unit 650 may calculate the correction amount for the image 510 by calculating conversion parameters of projective transformation from the image deviation information acquired by the image deviation information acquisition unit 615 and the information representing the shape of the image to be formed on the pre-cutting sheet included in the print job. The shape distortion correction unit 650 performs projective transformation on the image data before correction by using the conversion parameters.

As described above, the correction unit 620 corrects at least one of a position, a tilt, or a shape of an image formed on the pre-cutting sheet so as to eliminate a deviation of an image with respect to the post-cutting sheet based on the image deviation information related to a deviation of an image with respect to the post-cutting sheet.

Specific Example of Operation of Controller

Figure 7:
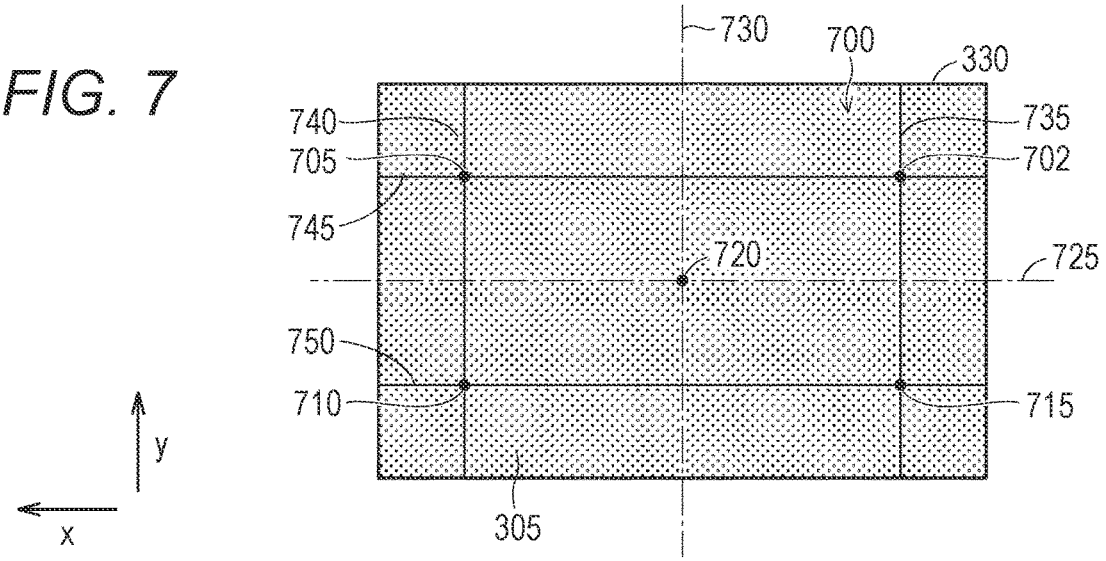
FIG. 7 is a diagram illustrating a post-cutting sheet obtained by cutting the pre-cutting sheet at a target cutting position.

A specific example of operation of the controller 125 in the first embodiment will be described with reference to FIGS. 7 to 10. FIG. 7 is a diagram illustrating a post-cutting sheet 330 obtained by cutting the pre-cutting sheet 300 at a target cutting position.

An inspection chart is used to obtain the image deviation information of the image with respect to the post-cutting sheet 330. The inspection chart is a dedicated image for the controller 125 to acquire the image deviation information based on the read image data. In the case of the example of FIG. 7, the inspection chart 700 includes mark lines 735, 740, 745, and 750 that are orthogonal to each other.

In the example of FIG. 7, each of the mark lines 735, 740, 745, and 750 is parallel to a corresponding outer edge of the image forming area 305 of the image based on the print job. Further, the distances between the mark lines 735, 740, 745, and 750 and the corresponding outer edges of the image forming area 305 are the same.

The image deviation information acquisition unit 615 calculates respective x-coordinates and y-coordinates of four intersections 702, 705, 710, and 715 of the mark lines 735, 740, 745, and 750 using an image recognition technique. Hereinafter, a lower edge of the post-cutting sheet is assumed as an x-axis direction, and a direction perpendicular to the direction is assumed as a y-axis direction.

The image deviation information acquisition unit 615 calculates the x-coordinate and y-coordinate of a center point 720, which is a virtual point representing the center of the inspection chart 700, based on the x-coordinates and y-coordinates of the four intersections 702, 705, 710, and 715. More specifically, the image deviation information acquisition unit 615 acquires the x-coordinate and the y-coordinate of the center point 720 by calculating respective average coordinates of the x-coordinates and the y-coordinates of the four intersections 702, 705, 710, and 715.

In the example of FIG. 7, the cutter 115 cuts the pre-cutting sheet 300 at a target cutting position. In this case, the center point 720 of the inspection chart coincides with the center point of the post-cutting sheet 330.

The image deviation information acquisition unit 615 calculates tilts of reference lines 725 and 730, which are virtual lines, in order to calculate a tilt of the image, that is, a tilt of the inspection chart 700.

More specifically, the image deviation information acquisition unit 615 calculates a tilt of the mark line 735 with respect to the y-axis and a tilt of the mark line 740 with respect to the y-axis by using the image recognition technique, and calculates an average value thereof as the tilt of the reference line 730 with respect to the y-axis. Here, the tilt of a certain line with respect to the y-axis (x-axis) represents an angle formed by the line and the y-axis (x-axis).

Similarly, the image deviation information acquisition unit 615 calculates a tilt of the mark line 745 with respect to the x-axis and a tilt of the mark line 750 with respect to the x-axis, and calculates an average value thereof as the tilt of the reference line 725 with respect to the x-axis.

Moreover, the image deviation information acquisition unit 615 can determine presence or absence of a shape distortion from a change in shape of a rectangle constituted of the four intersections 702, 705, 710, and 715.

In the example of FIG. 7, since the pre-cutting sheet 300 is cut at the target cutting position, the angle of each of the reference lines 725 and 730 with respect to the x-axis and the y-axis is zero. That is, the inspection chart 700 is not tilted with respect to the sheet edge of the post-cutting sheet 330.

Note that the shape of the inspection chart formed on the pre-cutting sheet is not limited to the example of FIG. 7. For example, the image may be an image in which a point is formed at each of positions of the intersections 702, 705, 710, and 715, without including the mark lines 735, 740, 745, and 750. The controller 125 may acquire coordinates of those points and calculate coordinates of the center point 720 and tilts of the reference lines 725 and 730 based on the coordinates. Thus, a tilt of the inspection chart with respect to the x-axis and the y-axis of the post-cutting sheet, and the position deviation amount between the coordinates of the center point 720 of the inspection chart and the center coordinates of the post-cutting sheet can be calculated. In addition, it can be determined that a shape distortion has occurred from a change in the relationship of coordinates of four points, that is, the shape of a rectangle constituted of the four points.

Further, when only the tilt of the chart with respect to the x-axis and y-axis and the position deviation amount between the center coordinates of the chart and the center coordinates of the post-cutting sheet are acquired and the shape distortion is not taken into consideration, an inspection chart with a simpler shape can be used. For example, an image in which the reference lines 725 and 730 are formed instead of the mark lines 735, 740, 745, and 750 may be used as the inspection chart.

Figure 8:
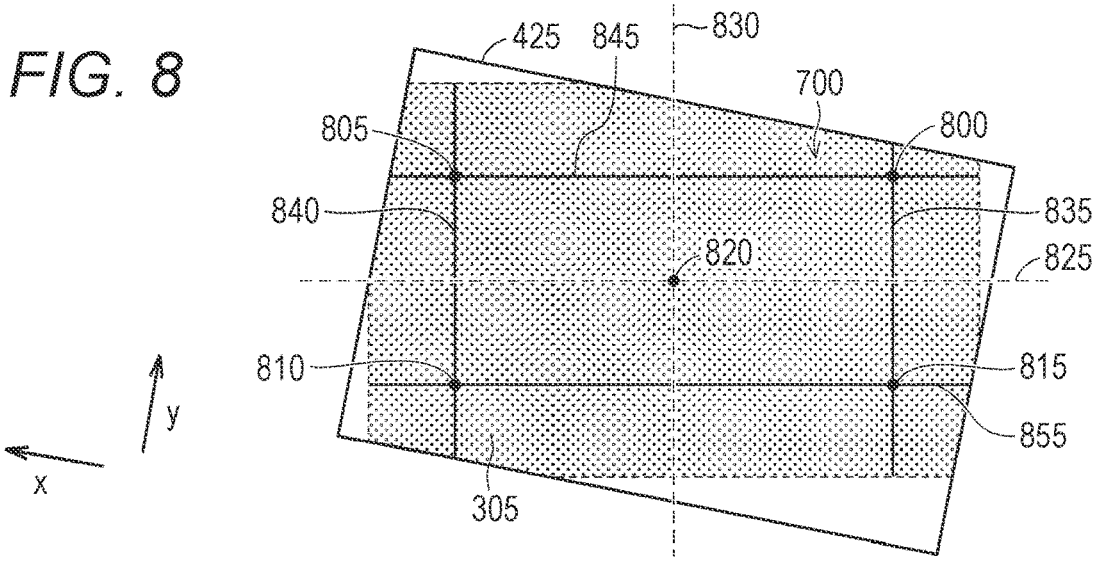
FIG. 8 is a diagram illustrating a post-cutting sheet when the pre-cutting sheet is cut at a cutting position different from the target cutting position due to faulty attachment of the cutter.

FIG. 8 is a diagram illustrating a post-cutting sheet 425 when the pre-cutting sheet 300 is cut at a cutting position different from the target cutting position due to faulty attachment of the cutter 115. As in the case of FIG. 7, an inspection chart 700 including mark lines 835, 840, 845, and 850 that are orthogonal to each other is used to acquire image deviation information.

With reference to FIG. 8, the image deviation information acquisition unit 615 calculates, as first center coordinates, x-coordinates and y-coordinates of a center point 820 that is a virtual point representing the center of the inspection chart 700 based on x-coordinates and y-coordinates of four intersections 800, 805, 810, and 815 of mark lines 835, 840, 845, and 850.

In the example of FIG. 8, unlike the example of FIG. 7, the cutter 115 cuts the pre-cutting sheet 300 at a cutting position different from the target cutting position. Therefore, the center point 820 of the inspection chart does not coincide with the center point of the post-cutting sheet 425. That is, in the example of FIG. 8, the first center coordinates and the second center coordinates which are the coordinates of the center point of the post-cutting sheet 425, do not coincide, and a deviation has occurred in the position of the inspection chart 700 formed on the post-cutting sheet 425.

Moreover, the inspection chart 700 is tilted with respect to the sheet edge of the post-cutting sheet 425. In other words, reference lines 825 and 830, which are virtual lines determined by the method described with reference to FIG. 7, are tilted with respect to the x-axis and the y-axis, respectively. Note that as in the case of FIG. 7, the x-axis and the y-axis are defined to be parallel and perpendicular to a sheet lower edge of the post-cutting sheet 425, respectively.

As described above, due to the faulty attachment of the cutter 115, an image deviation such as a position deviation and an image tilt has occurred in the post-cutting sheet 425. Note that in the case of the example of FIG. 8, no shape distortion has occurred in the inspection chart 700.

Figure 9:
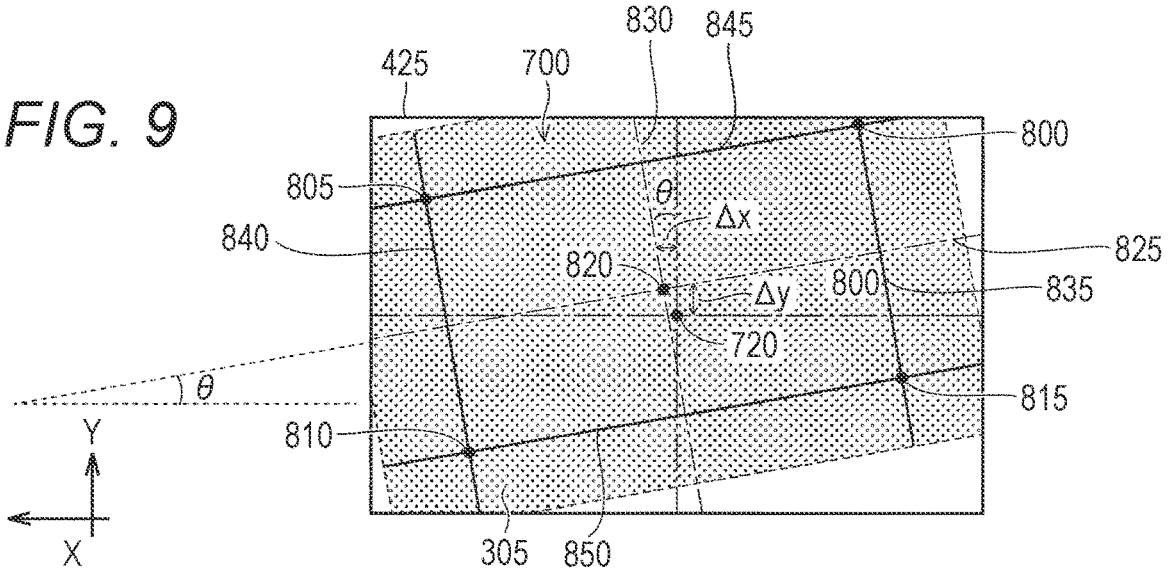
FIG. 9 is a diagram for explaining a method of acquiring image deviation information in a case where the pre-cutting sheet is cut at a cutting position different from the target cutting position as illustrated in FIG. 8.

Details of a method of acquiring the image deviation information will be described with reference to FIG. 9. FIG. 9 is a diagram for explaining a method of acquiring the image deviation information in a case where the pre-cutting sheet 300 is cut at a cutting position different from the target cutting position as illustrated in FIG. 8.

The image deviation information acquisition unit 615 calculates a tilt $\theta$ of the reference lines 825 and 830 with respect to the x-axis and the y-axis, respectively, in order to calculate a tilt of the inspection chart 700 with respect to the x-axis and the y-axis. Since no shape distortion has occurred in the inspection chart 700 of FIG. 9, the tilt of the inspection chart 700 with respect to the x-axis is equal to a tilt thereof with respect to the y-axis.

The image tilt correction unit 640 calculates a correction amount for correcting the tilt of the image formed on the post-cutting sheet based on the acquired tilt $\theta$ of the image. The image tilt correction unit 640 calculates the correction amount so that the tilt of the image formed on the post-cutting sheet becomes zero. The image tilt correction unit 640 corrects the original data for the image based on the calculated correction amount.

The position correction unit 645 calculates differences between the x-coordinate and y-coordinate of the center point 720 and the x-coordinate and y-coordinate of the center point 820, respectively, calculated by the image deviation information acquisition unit 615 and thereby calculates a position deviation amount $\Delta x$ in the x-axis direction and a position deviation amount $\Delta y$ in the y-axis direction. The position correction unit 645 calculates the correction amount of the position of the image formed on the post-cutting sheet based on the calculated position deviation amounts $\Delta x$ and $\Delta y$, and corrects the image based on the correction amount. More specifically, the position correction unit 645 corrects the original data for the image so that the entire image formed on the post-cutting sheet is shifted by the position deviation amount as compared with the entire image when the correction is not performed.

Note that unlike the example of FIG. 9, when an angle of the reference line 825 with respect to the x-axis and an angle of the reference line 830 with respect to the y-axis are different, a shape distortion has occurred in the inspection chart 700. In this case, the image deviation information acquisition unit 615 determines whether or not the shape distortion has occurred by the method described with reference to FIG. 5. Thereafter, as described with reference to FIG. 6, the shape distortion correction unit 650 calculates a correction amount for the shape distortion such as a parallelogram distortion, a magnification distortion, or a trapezoidal distortion of the image formed on the pre-cutting sheet. The shape distortion correction unit 650 corrects the shape of the image based on the correction amount.

In another aspect, the image deviation information acquisition unit 615 may calculate parallelism between a certain mark line and a mark line facing the mark line in the inspection chart 700, or angularity between a certain mark line and a mark line adjacent to the mark line, to thereby determine whether or not the shape distortion has occurred in the read image.

Figure 10:
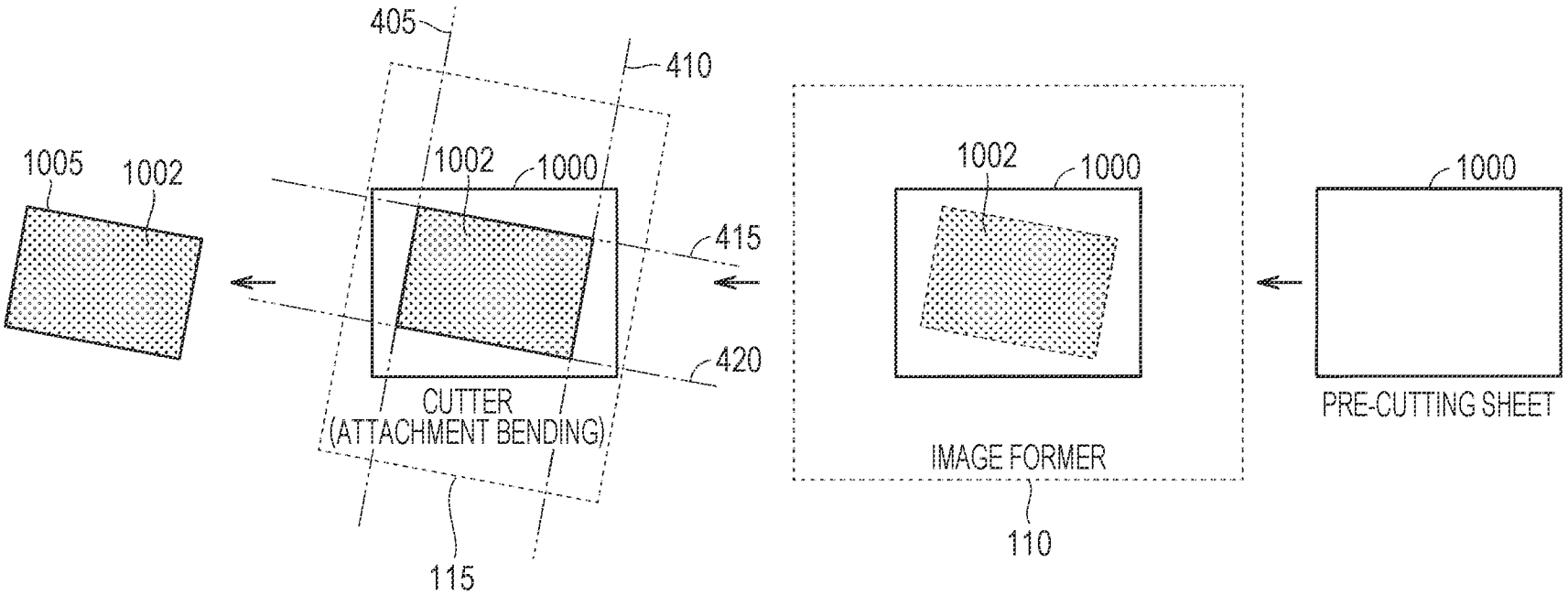
FIG. 10 is a diagram illustrating a state in which occurrence of image deviation is suppressed even if the attachment position of the cutter is faulty.

Effects of image correction based on the image deviation information will be described below. FIG. 10 is a diagram illustrating a state in which occurrence of image deviation is suppressed even if the attachment position of the cutter 115 is faulty.

With reference to FIG. 10, the image former 110 forms an image in an image forming area 1002 on a pre-cutting sheet 1000 according to a control signal from the controller 125. More specifically, as described with reference to FIG. 9, the image former 110 forms an image on the pre-cutting sheet 1000 according to the original data corrected based on the tilt θ of the inspection chart 700 with respect to the post-cutting sheet 425 and the position deviation amounts Δx and Δy.

Thus, even if the actual cutting position represented by the cutting lines 405, 410, 415, and 420 is different from the target cutting position due to the faulty attachment position of the cutter 115, it is possible to suppress occurrence of image deviation in the post-cutting sheet 1005. In the example of FIG. 10, it is possible to suppress the image on the post-cutting sheet 1005 from being tilted with respect to the post-cutting sheet.

[Control Procedure to Implement Correction]

Hereinafter, the description so far will be summarized with reference to FIGS. 11 and 12, and a control procedure for implementing the correction of an image formed on the post-cutting sheet will be described.

Figure 11:
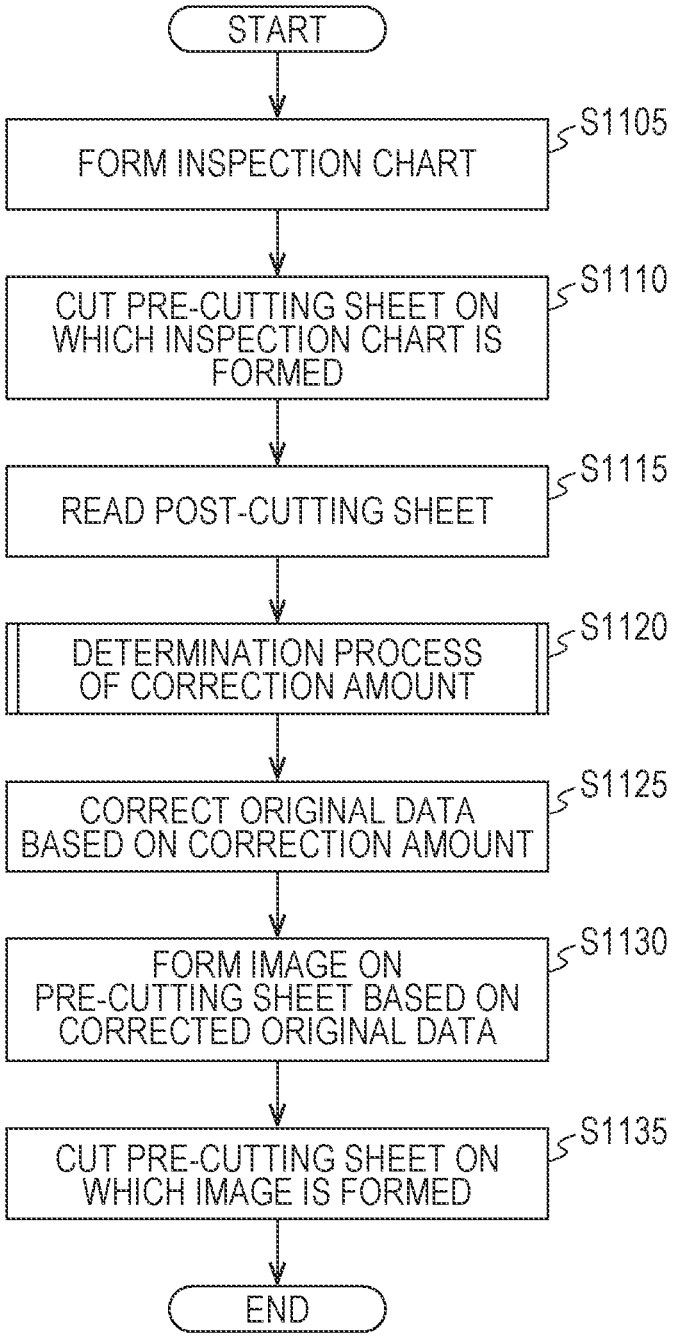
FIG. 11 is a flowchart illustrating an example of a process of correcting an image formed on the post-cutting sheet based on image deviation information.

FIG. 11 is a flowchart illustrating an example of a process of correcting an image formed on the post-cutting sheet based on image deviation information. In a certain aspect, operation of the controller 125 illustrated below is implemented by the CPU 220 executing a control program stored in the ROM 225.

In step S1105, the controller 125 transmits a control signal to the image former 110 so as to form an inspection chart on the pre-cutting sheet 300. The image former 110 forms the inspection chart on the pre-cutting sheet according to the signal. The inspection chart may be a dedicated image (also referred to as a "first inspection chart") for the controller 125 to acquire image deviation information based on read image data, similarly to the inspection chart 700. In another aspect, the inspection chart formed in step S1105 may be an image (also referred to as a "second inspection chart") for the controller 125 to receive the image deviation information from the user via the inputter 210. The second inspection chart will be described later with reference to FIG. 17 of a second embodiment.

In next step S1110, the controller 125 transmits a control signal to the cutter 115 so as to cut the pre-cutting sheet 300 on which the inspection chart is formed. The cutter 115 cuts the pre-cutting sheet 300 according to the signal. Thus, the post-cutting sheet 425 is obtained.

In next step S1115, the controller 125 transmits a control signal to the image reader 120 so as to read the post-cutting sheet 425. The image reader 120 generates read image data by optically reading the post-cutting sheet 425 according to the signal. Note that this step S1115 is not executed in a case of the second inspection chart.

Figure 18:
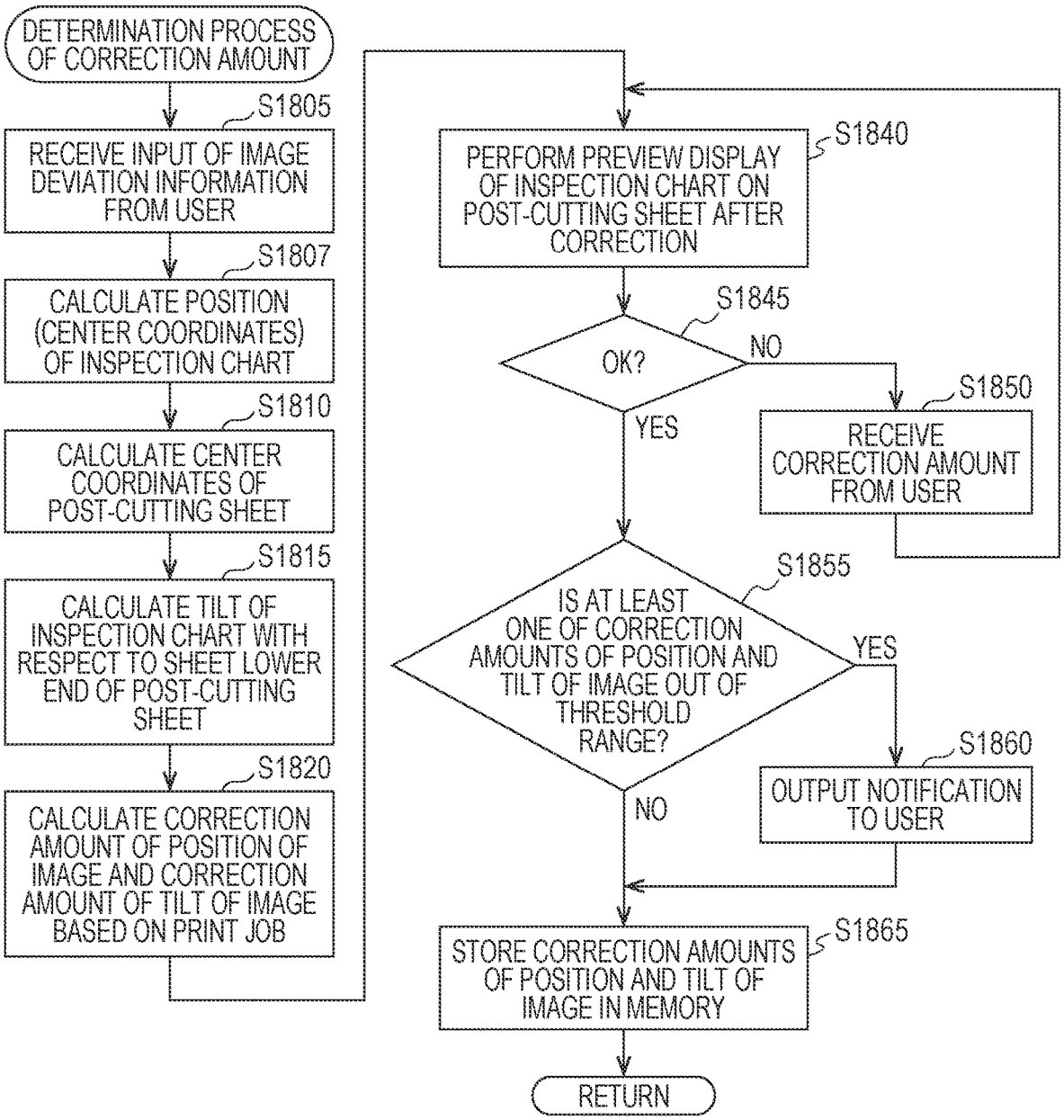
FIG. 18 is a flowchart illustrating an example of a process of correcting an image formed on a post-cutting sheet based on image deviation information input by a user.

In next step S1120, the controller 125 performs a determination process of a correction amount for correcting at least one of a position, a tilt, or a shape of the image formed on the pre-cutting sheet. Details of the process will be described later with reference to FIG. 12 (FIG. 18 in a case of the second embodiment). The correction amount determined in step S1220 is used when printing the original data based on the actual print job.

In next step S1125, the controller 125 corrects the original data based on the determined correction amount.

In next step S1130, the controller 125 transmits a control signal to the image former 110 so as to form an image on the pre-cutting sheet based on the corrected original data. The image former 110 forms an image on the pre-cutting sheet according to the signal.

In next step S1135, the controller 125 transmits a control signal to the cutter 115 so as to cut the pre-cutting sheet on which the image is formed. Thus, the user can obtain the post-cutting sheet on which the image without deviation is formed as set in the print job. As described above, the controller 125 ends the series of processes.

Figure 12:
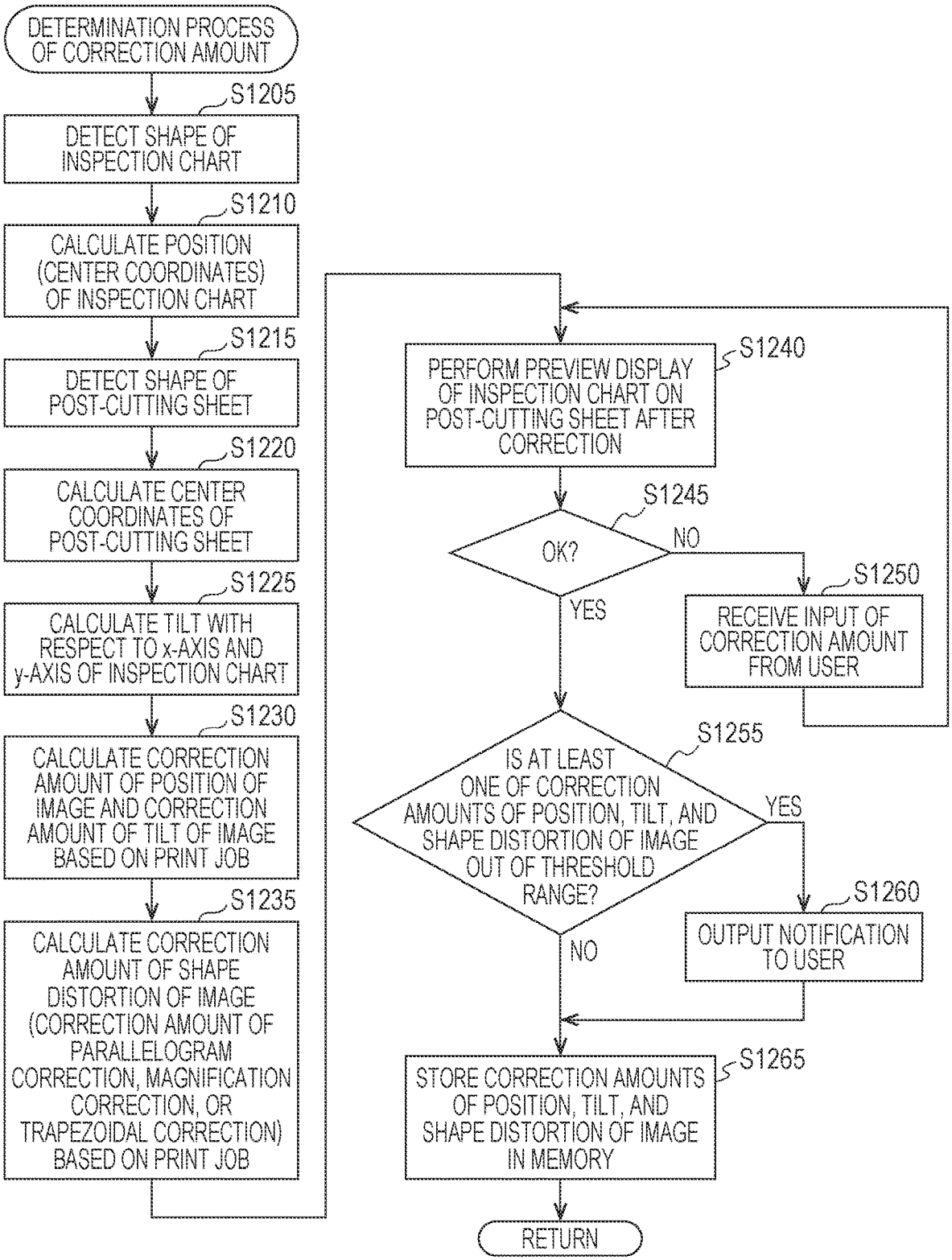
FIG. 12 is a flowchart illustrating details of a determination process of a correction amount (step S1120 in FIG. 11) by the controller in the first embodiment.

FIG. 12 is a flowchart illustrating details of the determination process of the correction amount (step S1120 in FIG. 11) by the controller 125 in the first embodiment. In the following description, FIG. 9 will be referred to as appropriate.

In step S1205 of FIG. 12, the controller 125 detects a shape of the inspection chart 700, specifically coordinates of the intersection points 800, 805, 810, and 815, based on the read image data.

In next step S1210, the controller 125 calculates a position of the inspection chart 700 with respect to the post-cutting sheet 425, as the image deviation information acquisition unit 615. More specifically, the controller 125 calculates first center coordinates, which are the coordinates of the center point 820 of the inspection chart 700.

In next step S1215, the controller 125 detects a shape of the post-cutting sheet 425 based on the read image data.

In next step S1220, the controller 125 calculates coordinates (second center coordinates) of the center point 720 of the post-cutting sheet 425 based on the read image data, as the image deviation information acquisition unit 615.

In next step S1225, the controller 125 calculates a tilt of the image with respect to the x-axis of the inspection chart and a tilt of the image with respect to the y-axis thereof, as the image deviation information acquisition unit 615. In the example of FIG. 9, the x-axis is the sheet lower edge of the post-cutting sheet 425, and the y-axis is perpendicular to the x-axis. The controller 125 calculates a tilt of the reference line 825 with respect to the x-axis and a tilt of the reference line 830 with respect to the y-axis. Their tilts are all θ.

In next step S1230, the controller 125 calculates a correction amount of the position of the image and a correction amount of the tilt of the image based on the print job, as the image tilt correction unit 640 and the position correction unit 645. In the example of FIG. 9, the controller 125 calculates −Δx and −Δy as the correction amount of the position of the image. Further, the controller 125 calculates −θ as a correction amount of the tilt of the image.

In next step S1235, the controller 125 calculates a correction amount of the shape distortion of the image based on the print job based on the shape of the inspection chart 700 acquired in the step S1205. More specifically, when the inspection chart is distorted into a parallelogram or trapezoid, or is expanded or contracted in a certain direction as compared with the original shape, the controller 125 can calculate a correction amount for parallelogram correction, magnification correction, or trapezoid correction, as the shape distortion correction unit 650.

In next step S1240, the controller 125 transmits a control signal to the display 215 so as to perform preview display of the inspection chart on the post-cutting sheet after correction. The display 215 performs preview display of the image according to the control signal from the controller 125. The screen displayed on the display 215 at this time will be described later with reference to FIG. 13.

In next step S1245, the controller 125 determines whether or not an OK button has been pressed by the user for the corrected image as a result of the preview display via the inputter 210. The OK button will be described with reference to FIG. 13.

When the user presses the OK button as a result of the preview display (YES in step S1245), the controller 125 advances the control to step S1255 based on a signal from the inputter 210.

On the other hand, when the user does not press the OK button (NO in step S1245), more specifically, when the user presses a correction amount adjustment button as described with reference to FIG. 13, the controller 125 advances the control to step S1250. In step S1250, the controller 125 receives an input of correction amount from the user. Thereafter, the controller 125 returns the control to step S1240.

In step S1255, the controller 125 determines whether or not at least one of the correction amounts of the position, the tilt of the image, or the shape distortion is out of a threshold range. Regarding the correction amount of the position, in the example of FIG. 9, it is determined whether or not $-\Delta x$ and $-\Delta y$ are out of a predetermined threshold range. Regarding the tilt of the image, it is determined whether or not $-\theta$ is out of a predetermined threshold range. Regarding the shape distortion, it is determined whether or not the correction amount described with reference to FIG. 5 is out of the predetermined threshold range. Each of the threshold ranges for the correction amounts of the position, the tilt of the image, and the shape distortion may be different. The threshold range may be predetermined at a time of manufacturing the printing apparatus 100, or may be set by the user who purchased the printing apparatus 100.

When at least one of the correction amounts of the position deviation, the tilt of the image, and the shape distortion is out of the threshold range (YES in step S1255), the controller 125 advances the control to step S1260. In step S1260, the controller 125 outputs a notification to the user. The controller 125 displays, for example, a message indicating that at least one of the correction amounts is out of the threshold range on the display 215. Thereafter, the controller 125 advances the control to step S1265.

On the other hand, when none of the above correction amounts is out of the threshold range (NO in step S1255), the controller 125 advances the control to step S1265.

In step S1265, the controller 125 stores the correction amounts of the position, the tilt of the image, and the shape distortion in the memory. By forming an image on the pre-cutting sheet using the stored correction amounts, it is possible to eliminate a deviation of the image with respect to the post-cutting sheet. Note that the memory may be either the HDD 235 or the storage medium 247. After storing the correction amounts in the memory, the controller 125 returns the control to step S1125 in FIG. 11.

A screen when the display 215 performs preview display of an image formed on the post-cutting sheet after correction will be described with reference to FIG. 13. FIG. 13 is a diagram illustrating an example of a screen 1300 displayed on the display 215 in step S1240 of FIG. 12.

Figure 13:
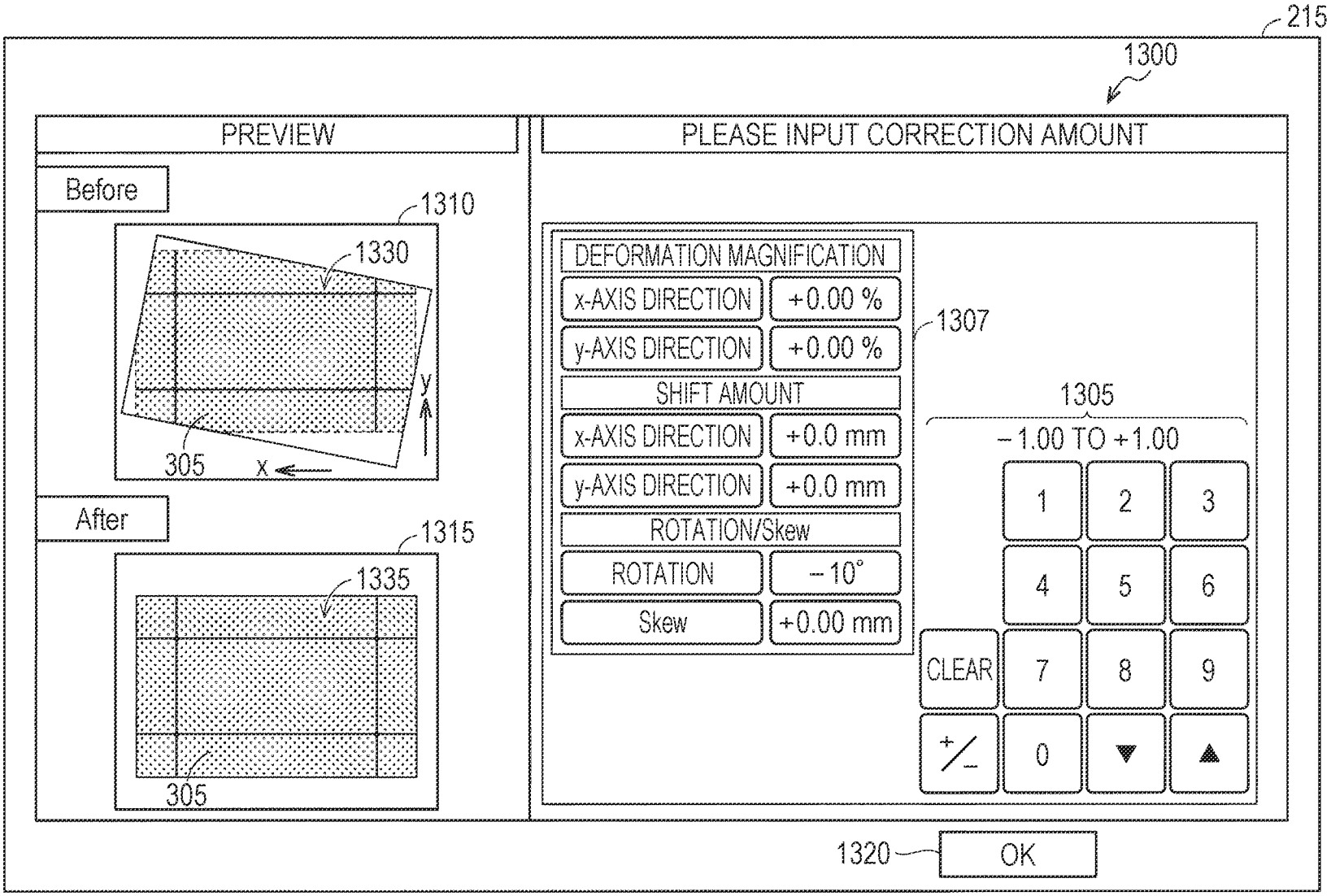
FIG. 13 is a diagram illustrating an example of a screen displayed on a display in step S1240 of FIG. 12.

In FIG. 13, a correction amount adjustment button 1305, a window 1307, windows 1310 and 1315, and an OK button 1320 are illustrated.

The correction amount adjustment button 1305 is used by the user to input a deformation magnification and a shift amount in the x-axis direction and the y-axis direction of the image formed on the post-cutting sheet after the correction amounts are determined. The correction amount adjustment button 1305 is also used for the user to input a correction amount such as a rotation amount (rotation angle) and a skew amount when the center point of the image is the center of rotation. In the example of FIG. 13, the direction parallel to the lower edge of the image forming area 305 displayed in the window 1310 is the x-axis direction, and the direction perpendicular to the x-axis direction is the y-axis direction.

The window 1307 illustrates the correction amount input by the user. In the example of FIG. 13, it is illustrated that the rotation amount as the correction amount is $-10°$ and the other correction amounts are 0 mm.

The window 1310 displays an image 1330 representing the inspection chart formed on the post-cutting sheet before a correction is made, based on the read image data. In the example of FIG. 13, in the window 1310, the image 1330 representing the inspection chart formed in the image forming area 305 is tilted with respect to the sheet edge of the post-cutting sheet.

On the other hand, the window 1315 performs preview display of the image 1335 illustrating the inspection chart formed on the post-cutting sheet when a correction is made. The image 1335 changes in conjunction with the input of the correction amount from the user via the correction amount adjustment button 1305. The user can visually check a change of the image 1335 in the window 1315 in conjunction with the input of the correction amount. In the example of FIG. 13, as a result of determination of the correction amount by the user while checking the preview display in the window 1315, the image 1335 is not tilted with respect to the sheet edge of the post-cutting sheet.

The OK button 1320 accepts an approval of the user for an automatically calculated correction amount or the correction amount input by the user. When the OK button 1320 is pressed, the currently set correction amount is applied to the image to be formed on the pre-cutting sheet thereafter. Consequently, the deviation of the image with respect to the post-cutting sheet is suppressed.

Advantages of determining the correction amount by the user using the screen 1300 will be described. As described with reference to FIGS. 9 and 10, the controller 125 can automatically calculate the correction amount for the image by calculating the tilt $\theta$, the position deviation amounts $\Delta x$ and $\Delta y$, or the like of the image formed on the post-cutting sheet. However, due to errors in the automatically calculated correction amount, a deviation of the image with respect to the post-cutting sheet may not be completely eliminated. In such a case, the user can input the correction amount according to the deviation of the image via the screen 1300 while visually checking the positional relationship between the post-cutting sheet and the image forming area 305. Thus, the deviation of the image on the post-cutting sheet can be further suppressed.

Figure 14:
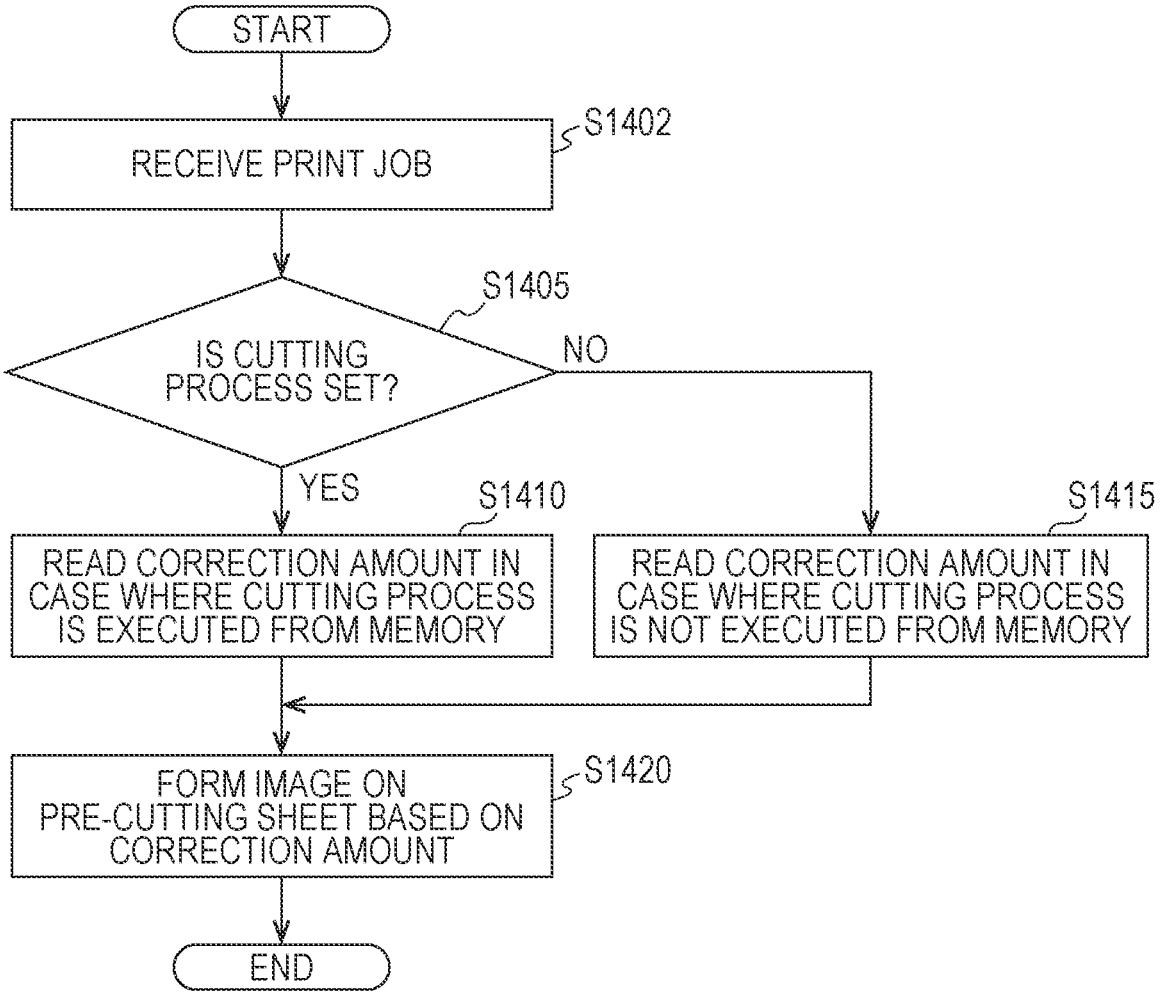
FIG. 14 is a diagram illustrating an example of a process in which the controller switches a correction amount of a printing apparatus according to presence or absence of a cutting process.
Figure 15:
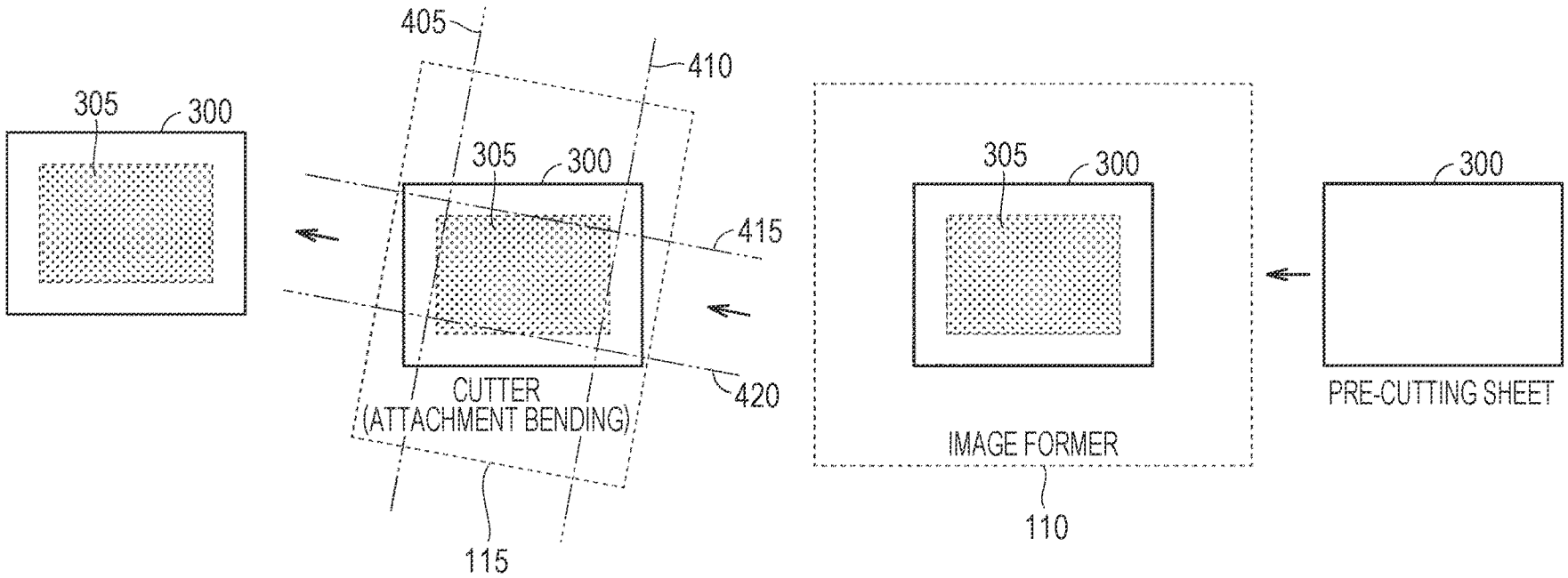
FIG. 15 is a diagram illustrating an example of operation of the printing apparatus when the cutting process is not set in a print job.

With reference to FIGS. 14 and 15, switching of the correction amount according to the presence or absence of a cutting process in the printing apparatus 100 will be described. FIG. 14 is a diagram illustrating an example of a process in which the controller 125 switches the correction amount of the printing apparatus 100 according to the presence or absence of a cutting process.

In step S1402, the controller 125 receives a print job via the communication device 250.

In step S1405, the controller 125 determines whether or not a cutting process is set in the received print job based on setting information included in the print job. When the cutting process is set (YES in step S1405), the controller 125 advances the control to step S1410. In next step S1410, the controller 125 reads the correction amount (also referred to as a "first correction amount") in a case where the cutting process is executed from the memory. The correction amount is a correction amount for the original data based on the image deviation information, which is used to correct a deviation of the image on the post-cutting sheet caused by the faulty attachment of the cutter 115. Thereafter, the controller 125 advances the control to step S1420.

On the other hand, when the cutting process is not set (NO in step S1405), the controller 125 advances the control to step S1415. In step S1415, the controller 125 reads the correction amount (also referred to as a "second correction amount") in a case where the cutting process is not executed from the memory without using the correction amount based on the image deviation information. The correction amount is different from the correction amount used in step S1410. Thereafter, the controller 125 advances the control to step S1420. Note that when the correction amount in the case where the cutting process is not executed is not stored in the memory, step S1415 will not be not executed.

In step S1420, the controller 125 forms the image on the pre-cutting sheet based on the correction amount read in step S1410 or step S1415. Thereafter, the controller 125 ends the series of processes.

FIG. 15 is a diagram illustrating an example of the operation of the printing apparatus 100 when the cutting process is not set in the print job.

In the example of FIG. 15, since the cutting process is not set in the received job, the controller 125 sends a control signal to the image former 110 so as to form an image on the sheet 300 without using the correction amount based on the image deviation information. Further, the controller 125 does not transmit to the cutter 115 a control signal to cut the sheet 300.

The image former 110 forms an image in the image forming area 305 on the sheet 300 according to the above signal. Therefore, the image forming area 305 is arranged in the center of the sheet 300.

The cutter 115 does not cut the sheet 300 because it has not received a control command to cut the sheet 300 from the controller 125.

As described above, the controller 125 switches the correction amount of image deviation according to the print job (first print job) in which the cutting process is set and the print job (second print job) in which the cutting process is not set. Thus, it is possible to suppress the image formed on the output sheet from deviating regardless of whether or not the cutting process is set in the print job.

Effect of First Embodiment

With the printing apparatus 100 according to the first embodiment, it is possible to suppress an image formed on the post-cutting sheet from deviating from the sheet edge of the post-cutting sheet due to faulty attachment of the cutter 115. Thus, quality of a printed matter after cutting can be improved regardless of the attachment position of the cutter 115.

Second Embodiment

Operation of the controller 125 when the controller 125 receives image deviation information from the user via the inputter 210 will be described with reference to FIGS. 16 to 18.

Figure 16:
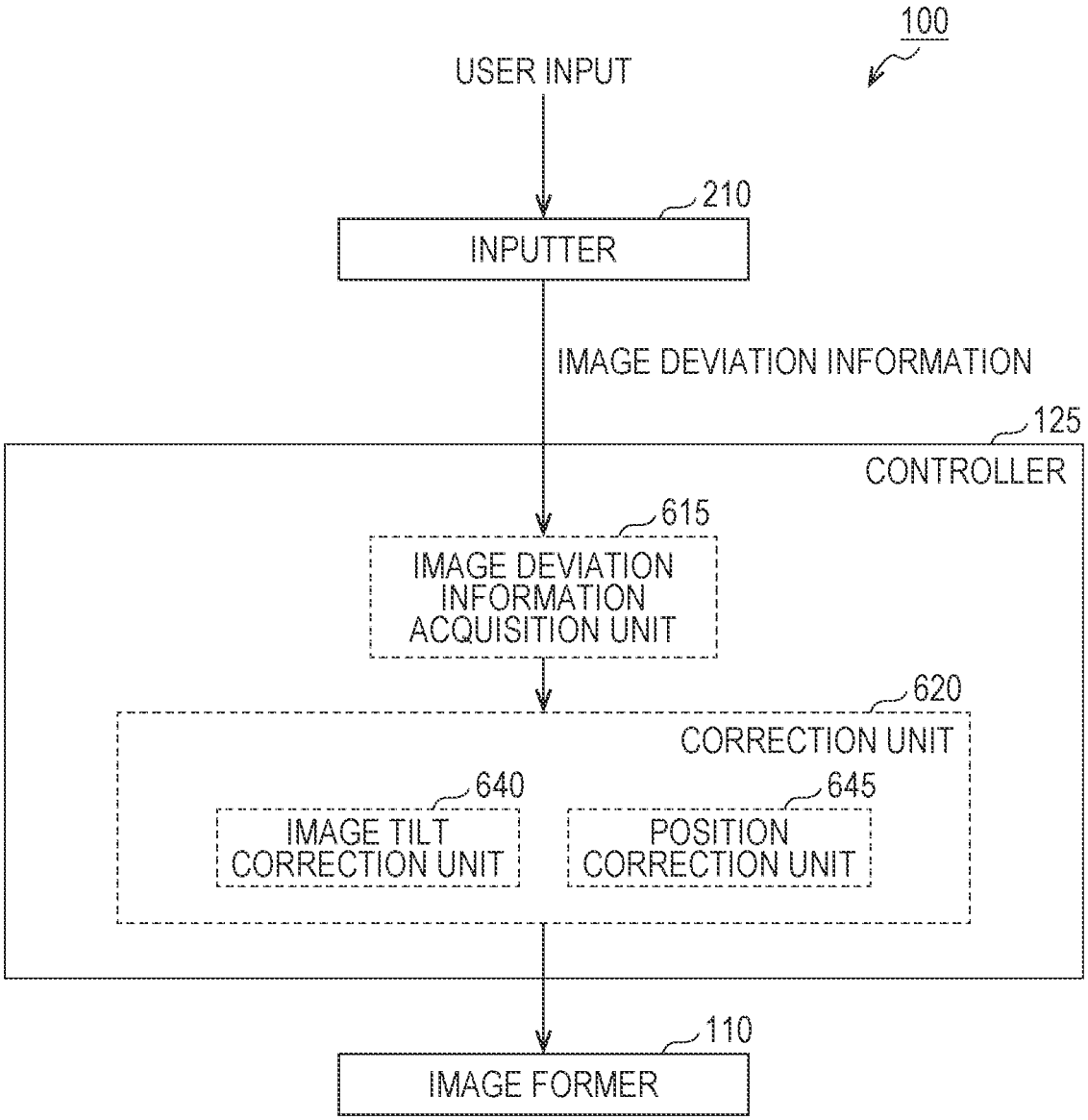
FIG. 16 is a diagram illustrating a configuration of a controller in a second embodiment.

FIG. 16 is a diagram illustrating a configuration of the controller 125 in a second embodiment. The controller 125 according to the second embodiment is different from the printing apparatus 100 in the first embodiment in that the image deviation information acquisition unit 615 receives image deviation information from the user via the inputter 210 instead of acquiring the image deviation information based on the read image data. Moreover, the correction unit 620 of FIG. 16 is not provided with the shape distortion correction unit 650. Since other points of FIG. 16 are similar to those of FIG. 6, the same or corresponding parts are designated by the same reference numerals and the description is not repeated.

Note that a hardware configuration of the printing apparatus 100 in the second embodiment is similar to the hardware configuration of the printing apparatus 100 illustrated in FIGS. 1 and 2 of the first embodiment. Therefore, the descriptions of them will not be repeated.

Figure 17:
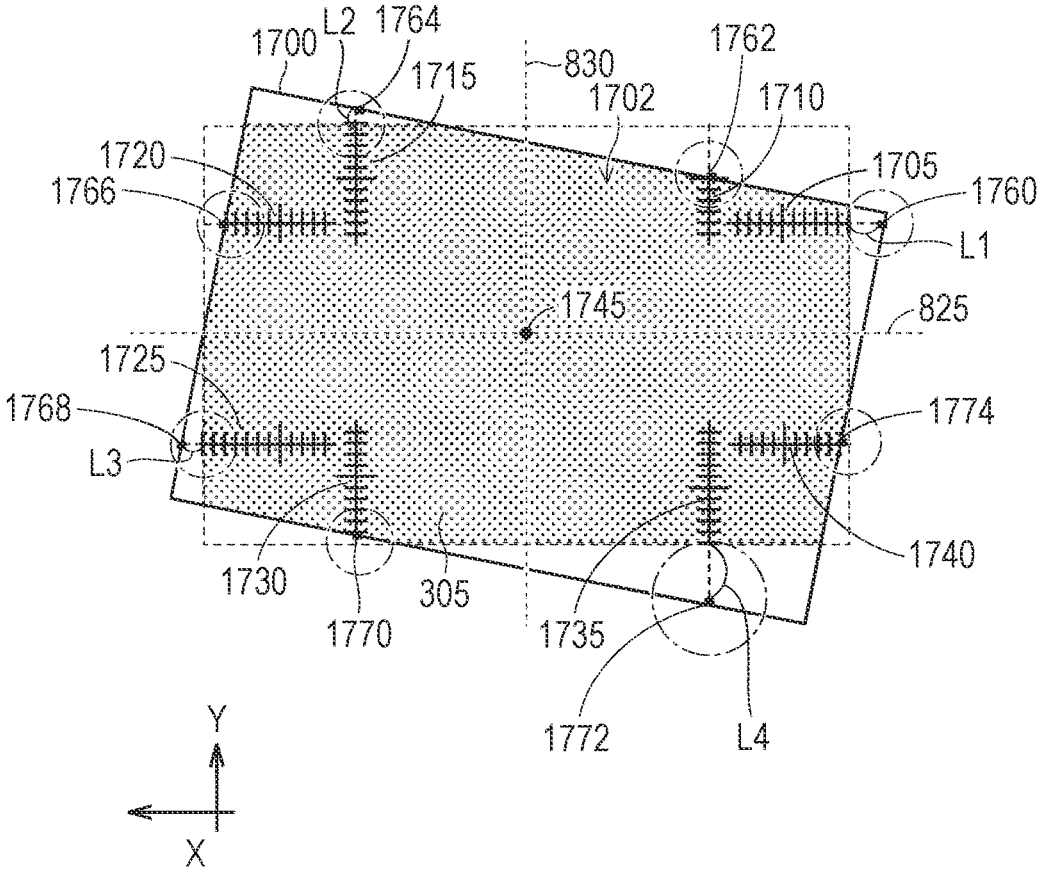
FIG. 17 is a diagram illustrating an example of an inspection chart for the controller to acquire image deviation information from the user via the inputter.

FIG. 17 is a diagram illustrating an example of an inspection chart 1702 for the controller 125 to acquire image deviation information from the user via the inputter 210. FIG. 17 illustrates an arrangement of the inspection chart 1702 on a post-cutting sheet 1700. The inspection chart 1702 (also referred to as a "second inspection chart") is used for the controller 125 to receive image deviation information related to a deviation of an image with respect to the post-cutting sheet 425 from the user.

With reference to FIG. 17, there are assumed reference lines 825 and 830, which are virtual lines passing through a center point 1745 of the rectangular image forming area 305. The image forming area 305 is axisymmetric with respect to each of the reference lines 825 and 830. Moreover, the reference line 825 is the x-axis and the reference line 830 is the y-axis. The origin of the x-y coordinates is the center of the inspection chart 1702.

The inspection chart 1702, illustrated as an example in FIG. 17, includes scale lines 1705, 1710, 1715, 1720, 1725, 1730, 1735, and 1740.

Specifically, the scale lines 1710 and 1715 correspond to an upper side of the image forming area 305 and are provided at positions line-symmetrical with respect to the reference line 830. Similarly, the scale lines 1730 and 1735 correspond to a lower side of the image forming area 305 and are provided at positions line-symmetrical with respect to the reference line 830. The scale lines 1705 and 1740 correspond to a right side of the image forming area 305 and are provided at positions line-symmetrical with respect to the reference line 825. The scale lines 1720 and 1725 correspond to a left side of the image forming area 305 and are provided at positions line-symmetrical with respect to the reference line 825. Each of the scale lines 1705 to 1740 starts from a corresponding side of the image forming area 305 and extends vertically from the corresponding side. A starting point of each scale line has a predetermined distance from a vertex of the image forming area 305. Each scale line is graduated at regular intervals.

A procedure for correcting a tilt and a position deviation of the image with respect to the post-cutting sheet will be described below using the inspection chart 1702.

First, the user can visually read values indicated by scale lines at intersections 1762, 1766, 1770, and 1774 between the scale lines 1710, 1720, 1730, and 1740 and sheet edges of the post-cutting sheet 1700.

Further, when the scale lines 1705, 1715, 1725, and 1735 are virtually extended and intersect with the sheet edges of the post-cutting sheet 1700, the user reads lengths L1, L2, L3, and L4 of the extended portions with a ruler. In FIG. 17, intersections of the virtually extended scale lines 1705, 1715, 1725, and 1735 and the sheet edges of the post-cutting sheet 1700 are intersections 1760, 1764, 1768, and 1772, respectively.

Thereafter, the user inputs values of the scale corresponding to the four intersections 1762, 1766, 1770, and 1774 with the sheet edges and the lengths L1, L2, L3, and L4 of the four extended portions via the inputter 210. The controller 125 acquires these values as image deviation information, as the image deviation information acquisition unit 615. Thus, as described below, the controller 125 as the correction unit 620 calculates the correction amount of the position deviation and tilt with respect to the post-cutting sheet 1700 of the inspection chart 1702.

First, the correction unit 620 calculates the x-y coordinates of the intersections 1762, 1766, 1770, and 1774 based on values entered by the user at the intersections 1762, 1766, 1770, and 1774 on the respective scale lines 1710, 1720, 1730, and 1740.

Further, the correction unit 620 calculates the x-y coordinates of the intersections 1760, 1764, 1768, and 1772 on the extended lines of the scale lines 1705, 1715, 1725, and 1735 based on the length values of L1, L2, L3, and L4 input by the user.

The correction unit 620 calculates x-y coordinates of four vertices of the post-cutting sheet 1700 from the x-y coordinates of the eight intersections 1760 to 1774 acquired in this manner.

For example, the correction unit 620 can calculate x-y coordinates of an upper left vertex of the post-cutting sheet 1700 from the intersection of a straight line connecting the intersections 1762 and 1764 and a straight line connecting the intersections 1766 and 1768. The correction unit 620 also calculates x-y coordinates of lower left, lower right, and upper right vertices of the post-cutting sheet 1700 in the same manner.

The correction unit 620 calculates x-y coordinates of a center of the post-cutting sheet 1700 from x-y coordinates of the four vertices of the post-cutting sheet 1700.

The correction unit 620 can calculate a tilt of each sheet edge of the post-cutting sheet 1700 with respect to the x-axis and the y-axis from the x-y coordinates of the eight intersections 1760 to 1774. For example, the correction unit 620 can calculate a tilt of a sheet upper edge of the post-cutting sheet 1700 with respect to the x-axis and the y-axis from the straight line connecting the intersections 1762 and 1764. The correction unit 620 can calculate tilts of a left edge, a lower edge, and a right edge of the post-cutting sheet 1700 by a similar method. When the shape distortion has not occurred, the tilt of the inspection chart 1702 with respect to the x-axis and the tilt with respect to the y-axis are the same. Here, from a tilt with respect to the x-axis of a sheet lower edge of the post-cutting sheet 1700, a tilt of the inspection chart 1702 with respect to the sheet lower edge of the post-cutting sheet 1700 is determined.

The position correction unit 645 calculates correction amounts of the position where the image based on the print job is formed from differences between coordinate values (0, 0) of the center point 1745 of the inspection chart 1702 and coordinate values of a center point of the post-cutting sheet 1700.

The image tilt correction unit 640 calculates a correction amount of a tilt of an image formed based on the print job based on the tilt of the inspection chart 1702 with respect to the x-axis or y-axis.

As described above, the image deviation information may be information input by the user using the second inspection chart. Further, the second inspection chart is not limited to the one illustrated in FIG. 17 as long as the positional relationship between the sheet edge of the post-cutting sheet and the inspection chart can be detected.

The controller 125 corrects the position and tilt of the image formed on the pre-cutting sheet based on the print job from the image deviation information input by the user. Thus, even when the printing system 50 does not include the image reader 120, it is possible to suppress occurrence of image deviation on the post-cutting sheet.

With reference to FIG. 18, a control procedure for implementing the correction of an image formed on the pre-cutting sheet in the second embodiment will be described.

FIG. 18 is a flowchart illustrating an example of a process of correcting an image formed on the post-cutting sheet based on image deviation information input by a user. In a certain aspect, operation of the controller 125 illustrated below is implemented by the CPU 220 executing the control program stored in the ROM 225. Note that in the following description, FIGS. 13 and 17 will be referred to as appropriate.

In step S1805 of FIG. 18, the controller 125 receives input of image deviation information from the user.

In next step S1807, the controller 125 calculates the position of the second inspection chart with respect to the post-cutting sheet based on the received image deviation information, as the image deviation information acquisition unit 615. More specifically, the controller 125 calculates the first center coordinates, which are the coordinates of the center point of the second inspection chart. Note that in the following steps, the method of taking the coordinate system is not limited. In the example of FIG. 17, since the coordinate system with the center of the image forming area 305 as the origin is used, the first center coordinates are (0, 0).

In next step S1810, the controller 125 calculates the center coordinates of the post-cutting sheet based on the received image deviation information, as the image deviation information acquisition unit 615. The controller 125 calculates x-y coordinates of four vertices of the post-cutting sheet 1700 by using, for example, the method described with reference to FIG. 17, and calculates the second center coordinates.

In next step S1815, the controller 125 calculates a tilt of the inspection chart with respect to the sheet lower edge of the post-cutting sheet, based on the received image deviation information. The controller 125 calculates a tilt of the image with respect to the sheet lower edge of the post-cutting sheet 1700 of the inspection chart 1702 by using, for example, the method described with reference to FIG. 17. In another aspect, the controller 125 may calculate the tilt of the inspection chart 1702 with respect to any of the sheet upper edge, the left edge, and the right edge of the post-cutting sheet 1700.

In step S1820, the controller 125 determines a correction amount of the position of the image and a correction amount of the tilt of the image based on the print job, as the image tilt correction unit 640 and the position correction unit 645. The controller 125 calculates the correction amount of the position from, for example, the differences between the first center coordinates calculated in step S1807 and the second center coordinates calculated in step S1810. Further, the controller 125 calculates the correction amount of the tilt of the image from, for example, the tilt of the inspection chart 1702 with respect to the sheet lower edge of the post-cutting sheet 1700 calculated in step S1815.

In next step S1840, the controller 125 transmits a control signal to the display 215 so as to perform preview display of the inspection chart on the post-cutting sheet after correction. The display 215 performs preview display of the image according to the control signal from the controller 125.

In next step S1845, the controller 125 determines whether or not an OK button has been pressed by the user for the corrected image as a result of the preview display via the inputter 210. The OK button is the same as that described with reference to FIG. 13.

When the user presses the OK button as a result of the preview display (YES in step S1845), the controller 125 advances the control to step S1855 based on a signal from the inputter 210.

On the other hand, when the user does not press the OK button (NO in step S1845), more specifically, when the user presses a correction amount adjustment button as described with reference to FIG. 13, the controller 125 advances the control to step S1850. In step S1850, the controller 125 receives an input of the correction amount from the user. Thereafter, the controller 125 returns the control to step S1840.

In step S1855, the controller 125 determines whether or not at least one of the correction amounts of the position and the tilt of the image is out of a threshold range. The correction amount of the position and the correction amount of the tilt of the image are the correction amounts calculated in step S1820. The threshold range may be predetermined at a time of manufacturing the printing apparatus 100, or may be set by the user who purchased the printing apparatus 100.

When at least one of the correction amounts of the position and the tilt of the image is out of the threshold range (YES in step S1855), the controller 125 advances the control to step S1860. In step S1860, the controller 125 outputs a notification to the user. The controller 125 displays, for example, a message indicating that at least one of the correction amounts is out of the threshold range on the display 215. Thereafter, the controller 125 advances the control to step S1865.

On the other hand, when none of the above correction amounts is out of the threshold range (NO in step S1855), the controller 125 advances the control to step S1865.

In step S1865, the controller 125 stores the correction amounts of the position, the tilt of the image, and the shape distortion in the memory. By forming an image on the pre-cutting sheet using the stored correction amounts, it is possible to eliminate a position deviation of the image with respect to the post-cutting sheet and a tilt of the image with respect to the sheet edge of the post-cutting sheet. Note that the memory may be either the HDD 235 or the storage medium 247. After storing the correction amounts in the memory, the controller 125 returns the control to step S1125 in FIG. 11.

Effect of Second Embodiment

With the printing apparatus 100 according to the second embodiment, even when the read image data is not used, a deviation of an image due to faulty attachment of the cutter 115 can be suppressed. Therefore, it is not always necessary to provide the image reader 120 as in the first embodiment, and it is possible to suppress an increase in size and cost of the printing apparatus 100.

Third Embodiment

In the first and second embodiments, the case where the controller 125 controls the image former 110 based on the image deviation information has been described. In this case, depending on the degree of faulty attachment of the cutter 115, the deviation of an image may be eliminated by the controller 125 controlling not only the image former 110 but also the steering rollers of the conveying unit 112.

For example, when the controller 125 controls the image former 110 based on the image deviation information as in the first and second embodiments, a tilt of the image with respect to a sheet edge of the post-cutting sheet may be out of the threshold range. In such a case, the deviation of the image can be further suppressed by tilting the direction of the sheet edge of the pre-cutting sheet diagonally with respect to the conveying direction by using the steering rollers.

In the third embodiment, a case where the controller 125 controls the steering rollers of the conveying unit 112 in order to suppress a tilt of the image formed on the post-cutting sheet will be described with reference to FIGS. 19 to 21.

Note that a hardware configuration of the printing apparatus 100 in the third embodiment is similar to the hardware configuration of the printing apparatus 100 in the first and second embodiments described with reference to FIGS. 1 and 2. Therefore, the same or corresponding parts are designated by the same reference numerals, and the description is not repeated.

The controller 125 individually controls the rotation speed of each of the steering rollers constituting the roller pair 144 in FIG. 1 so that the tilt of the image on the post-cutting sheet becomes zero. The angle between the FD direction of the cutter 115 and the direction of the sheet edge of the pre-cutting sheet 300, that is, the rotation angle of the pre-cutting sheet 300 in a sheet plane can be adjusted according to a rotation speed difference between the two steering rollers.

The relationship between the rotation speed difference between one of the rollers and the other and the tilt of the image on the post-cutting sheet according to the speed difference can be determined in advance by an experiment or the like. The controller 125 calculates the rotation speed difference according to the tilt as a steering adjustment amount based on the relationship and the tilt of the image with respect to the sheet edge of the post-cutting sheet, which has been calculated from the image deviation information. Thus, even when the controller 125 cannot eliminate the tilt of the image forming area 305 only by controlling the image former 110, the tilt of the image formed on the post-cutting sheet by controlling the steering adjustment amount can be corrected to zero.

Figure 19:
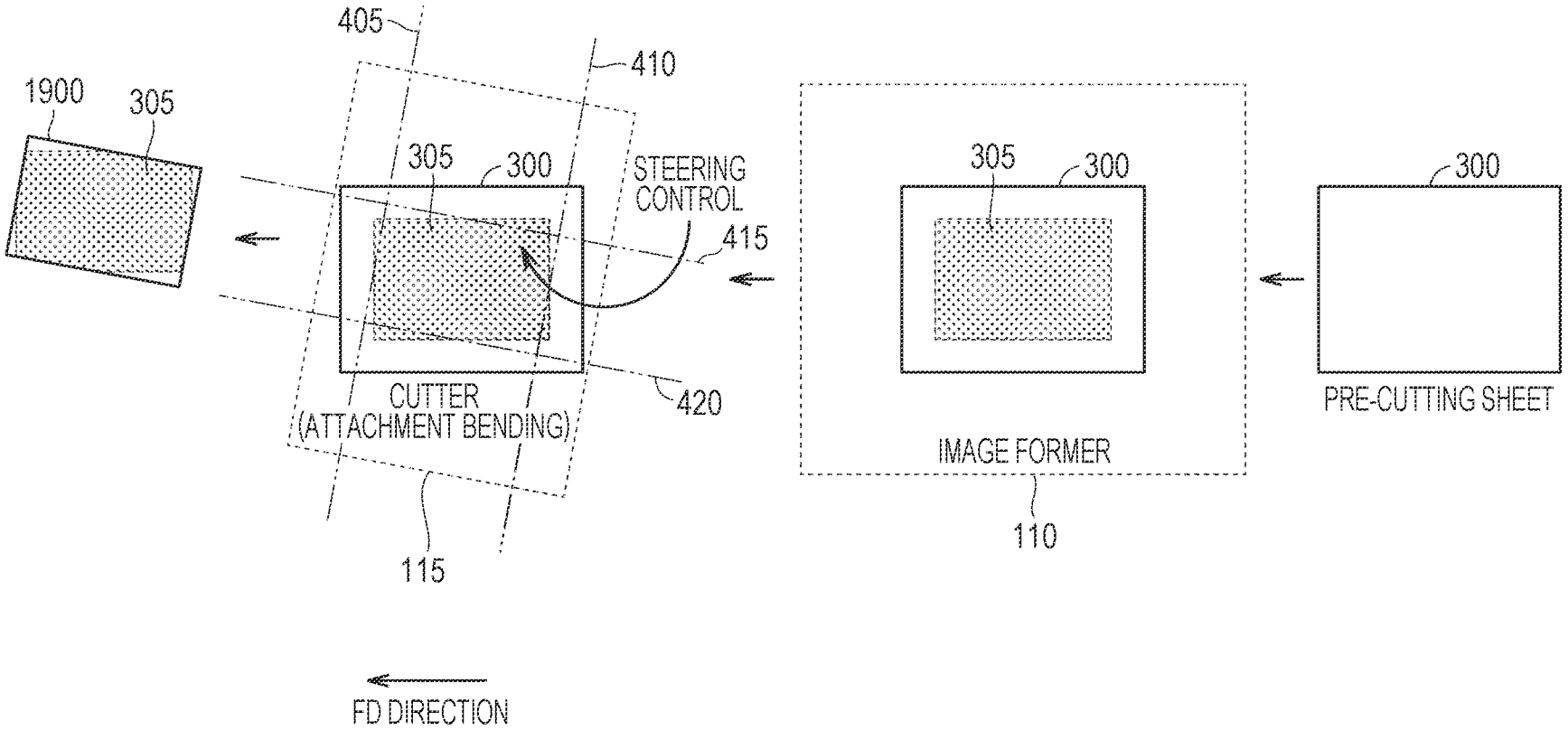
FIG. 19 is a diagram illustrating a state in which the controller controls a steering roller of a conveying unit to suppress a tilt of the image formed on the post-cutting sheet.
Figure 20:
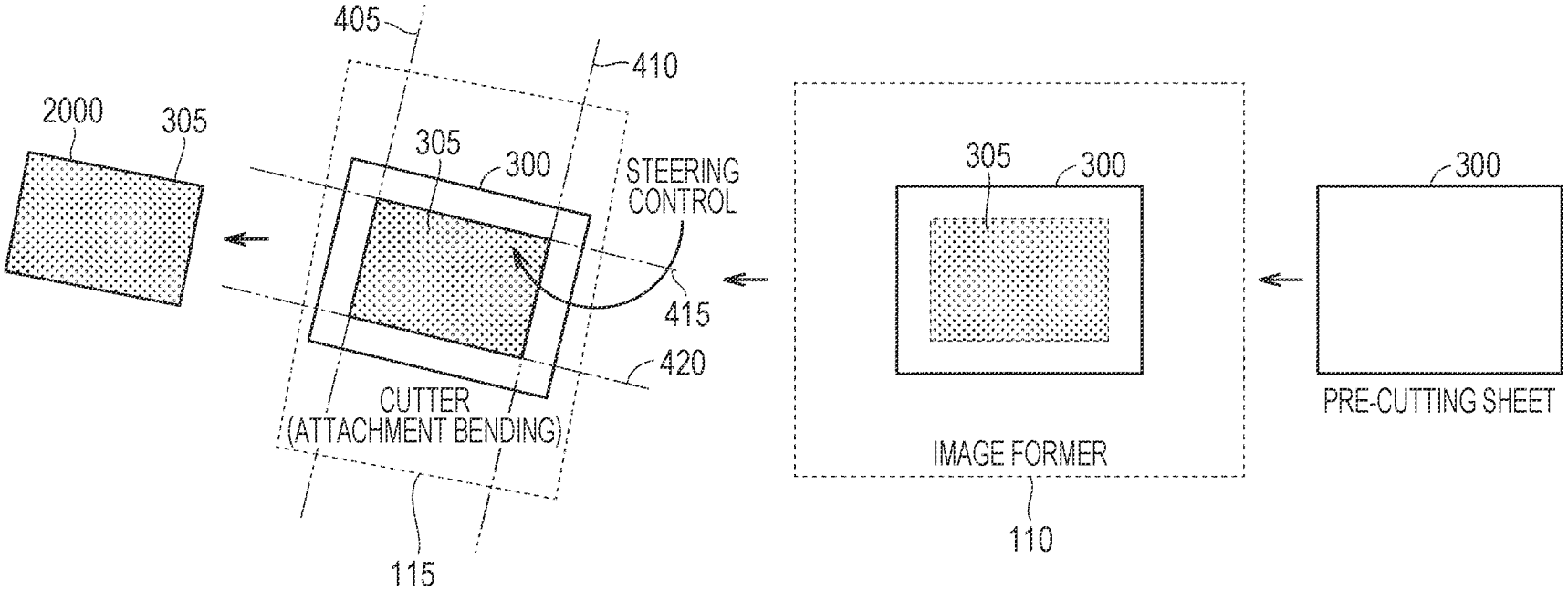
FIG. 20 is a diagram illustrating a state in which the controller controls the steering roller of the conveying unit to suppress a tilt of the image formed on the post-cutting sheet.

FIGS. 19 and 20 are views illustrating a state in which the controller 125 controls the steering rollers of the conveying unit 112 to suppress the tilt of the image formed on the post-cutting sheet.

FIG. 19 illustrates a case where the steering control is insufficient. That is, as illustrated in FIG. 19, the image forming area 305 is tilted with respect to the post-cutting sheet 1900, even after the steering control is performed. In such a case, the controller 125 may perform feedback control on the rotation speed difference so that the deviation from a target value of the tilt of the image becomes zero.

For example, the controller 125 acquires a tilt $\theta$ of the image with respect to the post-cutting sheet as a control amount from the read image data. The controller 125 calculates a deviation ($-\theta$) of the tilt $\theta$ with respect to the target value (that is, zero). The controller 125 calculates the steering adjustment amount as an operation amount by performing a control calculation based on PID control or the like with respect to the deviation. The controller 125 changes the rotation speeds of the steering rollers according to the calculated steering adjustment amount. By repeating the above procedure, the controller 125 can change the tilt of the image with respect to the post-cutting sheet to zero.

Thus, as illustrated in FIG. 20, even when the actual cutting position represented by the cutting lines 405, 410, 415, and 420 is tilted diagonally with respect to the target cutting position, the outer edge of the image forming area 305 can be made to be along the cutting line. Consequently, it is possible to suppress the image formed in the image forming area 305 from being tilted with respect to the post-cutting sheet 2000.

Figure 21:
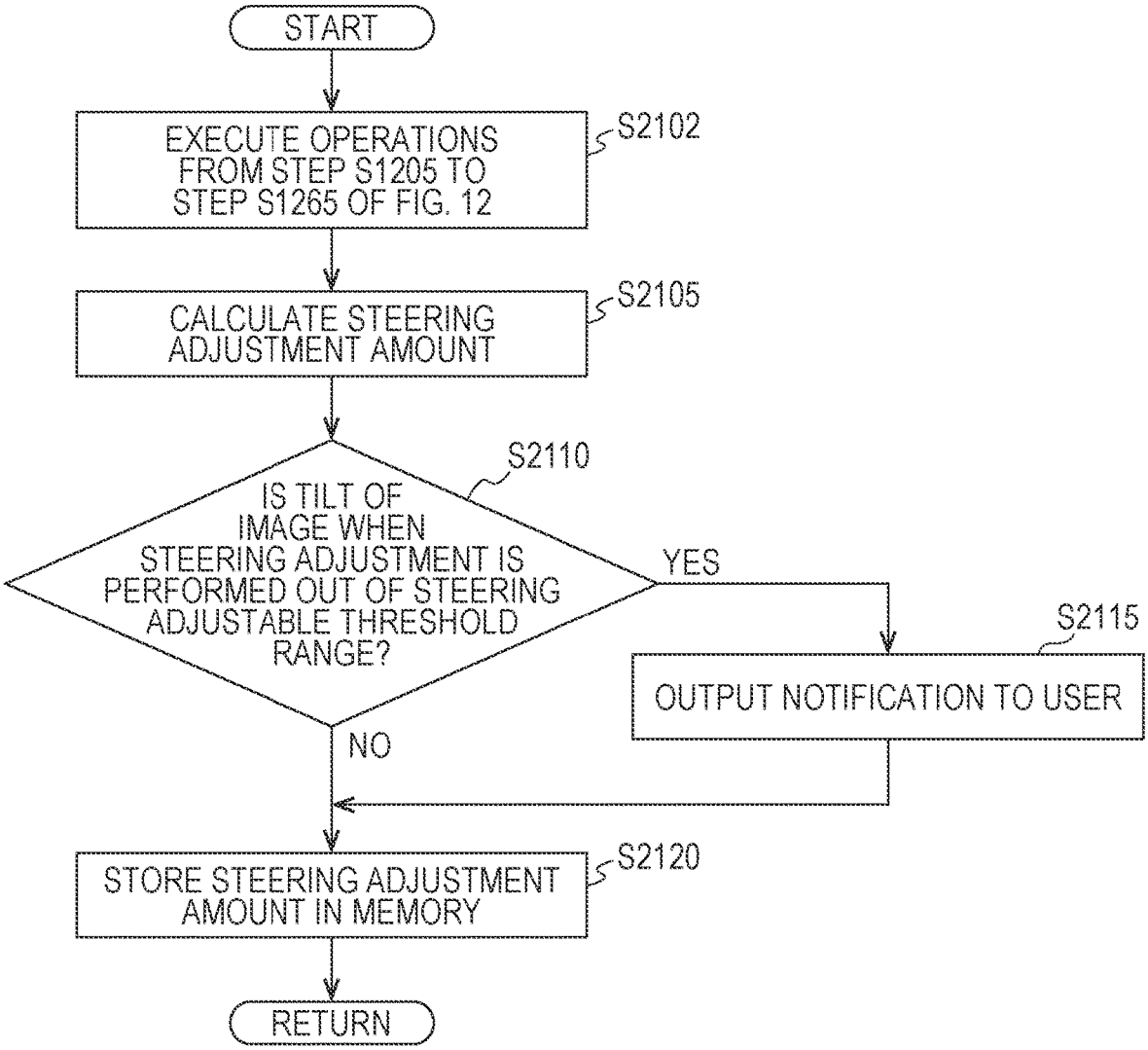
FIG. 21 is a diagram illustrating an example of processing for avoiding tilting of the image on the post-cutting sheet by the controller controlling the steering roller of the conveying unit.

FIG. 21 is a diagram illustrating an example of processing for avoiding tilting of the image on the post-cutting sheet by the controller 125 controlling the steering roller of the conveying unit 112. In a certain aspect, operation of the controller 125 illustrated below is implemented by the CPU 220 executing the control program stored in the ROM 225.

In step S2102, the controller 125 executes the operation from step S1205 to step S1265 in FIG. 12. In another aspect, the controller 125 may execute the operation from step S1805 to step S1865 in FIG. 18 instead of this operation.

In step S2105, the controller 125 calculates the steering adjustment amount as described above based on the tilt of the inspection chart calculated in step S1225 of FIG. 12 executed in step S2102. In another aspect, when the operations from step S1805 to step S1865 of FIG. 18 are executed in step S2102, the controller 125 may calculate the steering adjustment amount as described above based on the tilt of the inspection chart calculated in step S1815.

In step S2110, it is determined whether or not the tilt of the image when adjusting the steering is out of the steering adjustable threshold range. When the tilt of the image when adjusting the steering is out of the threshold range (YES in step S2110), the controller 125 advances the control to step S2115. In step S2115, the controller 125 outputs a notification to the user. More specifically, the controller 125 causes the display 215 to display a message of being out of the range. In this case, it means that the attachment position of the cutter 115 on the image former 110 is faulty in such a degree that the tilt of the image formed on the post-cutting sheet will not be eliminated even if the controller 125 controls the steering rollers of the conveying unit 112 based on the image deviation information. The message may motivate the user to adjust the attachment position of the cutter 115. Thereafter, the controller 125 advances the control to step S2120.

On the other hand, if the tilt of the image when adjusting the steering is not out of the above threshold range (NO in step S2110), the controller 125 advances the control to step S2120.

In step S2110, the controller 125 stores the steering adjustment amount in the memory. Thereafter, the controller 125 returns the control to step S1130 in FIG. 11 and executes steps S1125, S1130, and S1135. In step S1135, the controller 125 performs steering control based on the calculated steering adjustment value, and then transmits a control signal to the cutter 115 so as to cut the pre-cutting sheet on which the image is formed. Thereafter, the controller 125 ends the series of controls.

Effect of Third Embodiment

Even if a tilt of an image on the post-cutting sheet with respect to the post-cutting sheet is out of the predetermined threshold range even after the controller 125 corrects the original data based on the image deviation information, the tilt of the image can be suppressed.

Other Modification Examples

In FIGS. 11, 12, 14, 18, and 21, the configuration example is illustrated in which the CPU 220 implements processing required to execute a program. In other aspects, some or all of these provided processes may be implemented using a dedicated hardware circuit (for example, a dedicated circuit such as an application specific integrated circuit (ASIC), a field-programmable gate array (FPGA), or the like).

Further, in each embodiment, the program may be stored in the storage medium 247 instead of the ROM 225 or the HDD 235. The storage medium 247 may be achieved by a non-volatile storage medium such as a compact disc-read only memory (CD-ROM), a digital versatile disk-read only memory (DVD-ROM), a universal serial bus (USB) memory, a memory card, a flexible disk (FD), a magnetic tape, a cassette tape, a magnetic optical disc (MO), a MiniDisc (MD), an integrated circuit (IC) card (excluding memory cards), an optical card, a mask ROM, an EPROM, an electronically erasable programmable read-only memory (EEPROM), or the like. Further, the printing apparatus 100 may acquire the program, for example, by downloading via the communication line 102.

Further, the program may be provided by being incorporated into a part of an arbitrary program, not as a single program. In this case, the processing according to each embodiment is achieved in cooperation with an arbitrary program. Even a program that does not include such a part of modules does not deviate from the purpose of the program according to each embodiment. Moreover, the printing apparatus 100 may be configured in the form of what is called a cloud service in which at least one server executes a part of the processing of the program.

Although embodiments of the present invention have been described and illustrated in detail, the disclosed embodiments are made for purposes of illustration and example only and not limitation. The scope of the present invention should be interpreted not by terms of the above description but by terms of the appended claims, and it is intended that all modifications are included in the meaning and scope equivalent to the claims.

What is claimed is:

1. A printing apparatus comprising:

an image former that forms an image on a pre-cutting sheet;

a cutter that cuts the pre-cutting sheet on which the image is formed; and a hardware processor that controls the image former, wherein the hardware processor:

acquires image deviation information indicating a deviation of an image with respect to a post-cutting sheet on which the image is formed, the image deviation information being acquired after forming the image on a pre-cutting sheet and subsequently cutting the pre-cutting sheet to obtain the post-cutting sheet, and corrects at least one of a position, a tilt, and a shape of an image formed on the pre-cutting sheet so as to eliminate the deviation of the image based on the image deviation information.

2. The printing apparatus according to claim 1, further comprising an image reader that generates read image data by optically reading a shape of the post-cutting sheet and the image on the post-cutting sheet, wherein the hardware processor acquires the image deviation information based on the read image data.

3. The printing apparatus according to claim 2, wherein:

the hardware processor forms a first inspection chart as a dedicated image for acquiring the image deviation information on the pre-cutting sheet by the image former, the cutter cuts the pre-cutting sheet on which the first inspection chart is formed, the image reader optically reads the first inspection chart on the post-cutting sheet, and the hardware processor acquires the image deviation information based on the first inspection chart on the post-cutting sheet that is optically read.

4. The printing apparatus according to claim 3, wherein the hardware processor:

acquires a tilt of the first inspection chart with respect to a sheet edge of the post-cutting sheet as the image deviation information, and corrects a tilt of the image formed on the pre-cutting sheet based on a print job based on the tilt of the first inspection chart that has been acquired.

5. The printing apparatus according to claim 4, wherein:

the cutter includes a steering roller that tilts a direction of the sheet edge of the pre-cutting sheet diagonally with respect to a conveying direction of the pre-cutting sheet, and the hardware processor adjusts the tilt of the image with respect to the post-cutting sheet based on a print job by controlling the steering roller based on the tilt of the first inspection chart that has been acquired.

6. The printing apparatus according to claim 4, wherein the hardware processor:

acquires a shape of the first inspection chart on the post-cutting sheet as the image deviation information, and corrects the shape of the image formed on the pre-cutting sheet based on the print job based on a distortion of the shape of the first inspection chart that has been acquired.

7. The printing apparatus according to claim 6, wherein the correcting the shape of the image includes at least one of correcting a parallelogram distortion of the image, correcting a trapezoidal distortion of the image, and correcting a magnification of the image.

8. The printing apparatus according to claim 3, wherein the hardware processor:

acquires a relative position of the first inspection chart with respect to the post-cutting sheet as the image deviation information, and corrects a position of the image formed on the pre-cutting sheet based on a print job based on the relative position that has been acquired.

9. The printing apparatus according to claim 8, wherein the hardware processor:

calculates first center coordinates, which are center coordinates of the first inspection chart formed on the post-cutting sheet, calculates second center coordinates, which are center coordinates of the post-cutting sheet on which the first inspection chart is formed, and corrects the position of the image formed on the pre-cutting sheet based on the print job in such a manner that the first center coordinates and the second center coordinates coincide.

10. The printing apparatus according to claim 1, further comprising an inputter that receives an input from a user, wherein the hardware processor:

forms a second inspection chart on the pre-cutting sheet by the image former as a dedicated image for acquiring the image deviation information, and receives information regarding a positional relationship between a sheet edge of the pre-cutting sheet and the second inspection chart as the image deviation information via the inputter.

11. The printing apparatus according to claim 10, wherein:

the cutter further includes a steering roller that tilts a direction of the sheet edge of the pre-cutting sheet diagonally with respect to a conveying direction of the pre-cutting sheet, and the hardware processor:

calculates a tilt of the second inspection chart with respect to the sheet edge of the post-cutting sheet based on the image deviation information, and controls the steering roller based on the calculated tilt of the second inspection chart to adjust a tilt of the image with respect to the post-cutting sheet based on a print job.

12. The printing apparatus according to claim 1, further comprising a display that displays an image, wherein the hardware processor performs, on the display, a preview display of an image on the post-cutting sheet when a correction based on the image deviation information is not performed and an image on the post-cutting sheet when the correction based on the image deviation information is performed.

13. The printing apparatus according to claim 1, further comprising a storage device that stores a first correction amount and a second correction amount, wherein the first correction amount is at least one correction amount of a position, a tilt, and a shape of the image formed on the pre-cutting sheet when a cutting process is executed, the second correction amount is at least one correction amount of a position, a tilt, and a shape of the image formed on the sheet when the cutting process is not executed, and the hardware processor at least one of:

corrects, when the cutting process is set in an input print job, image data of the input print job by using the first correction amount, and corrects, when the cutting process is not set in the input print job, the image data of the input print job by using the second correction amount.

14. The printing apparatus according to claim 1, wherein the hardware processor:

calculates a correction amount of the position of the image, a correction amount of the tilt of the image, and a correction amount for a distortion of the shape of the image, determines whether or not at least one of the calculated correction amounts is outside a predetermined threshold range, and outputs a notification to a user when at least one of the correction amounts is out of the threshold range.

15. A control method of a printing apparatus, wherein the printing apparatus includes: an image former that forms an image on a pre-cutting sheet; a cutter that cuts the pre-cutting sheet on which the image is formed; and a hardware processor that controls the image former, and wherein the control method comprises:

acquiring, by the hardware processor, image deviation information indicating a deviation of an image with respect to a post-cutting sheet on which the image is formed, the image deviation information being acquired after forming the image on a pre-cutting sheet and subsequently cutting the pre-cutting sheet to obtain the post-cutting sheet; and correcting, by the hardware processor, at least one of a position, a tilt, and a shape of an image formed on the pre-cutting sheet so as to eliminate the deviation of the image based on the image deviation information.

16. A non-transitory recording medium storing a computer readable control program of a printing apparatus, wherein the printing apparatus includes: an image former that forms an image on a pre-cutting sheet; a cutter that cuts the pre-cutting sheet on which the image is formed; and a hardware processor that controls the image former, and wherein the control program causes a computer to perform operations comprising:

acquiring image deviation information indicating a deviation of an image with respect to a post-cutting sheet on which the image is formed, the image deviation information being acquired after forming the image on a pre-cutting sheet and subsequently cutting the pre-cutting sheet to obtain the post-cutting sheet; and correcting at least one of a position, a tilt, and a shape of an image formed on the pre-cutting sheet so as to eliminate the deviation of the image based on the image deviation information.

* * * * *